US010896778B2

(12) United States Patent
Shirouzu et al.

(10) Patent No.: US 10,896,778 B2
(45) Date of Patent: Jan. 19, 2021

(54) TRANSFORMER INCLUDING GAPS

(71) Applicant: FANUC CORPORATION, Yamanashi (JP)

(72) Inventors: Masatomo Shirouzu, Yamanashi (JP); Kenichi Tsukada, Yamanashi (JP)

(73) Assignee: Fanuc Corporation, Yamanashi (JP)

( * ) Notice: Subject to any disclaimer, the term of this patent is extended or adjusted under 35 U.S.C. 154(b) by 0 days.

(21) Appl. No.: 15/843,171

(22) Filed: Dec. 15, 2017

(65) Prior Publication Data

US 2018/0182529 A1 Jun. 28, 2018

(30) Foreign Application Priority Data

Dec. 22, 2016 (JP) ..... 2016-249312

(51) Int. Cl.

| | |
|---|---|
| ***H01F 30/12*** | (2006.01) |
| ***H01F 27/24*** | (2006.01) |
| ***H01F 27/28*** | (2006.01) |
| ***H01F 3/12*** | (2006.01) |

(52) U.S. Cl.

CPC ..... *H01F 27/24* (2013.01); *H01F 3/12* (2013.01); *H01F 27/28* (2013.01); *H01F 30/12* (2013.01)

(58) Field of Classification Search

CPC ..... H01F 30/12; H01F 3/12
USPC ..... 336/5
See application file for complete search history.

(56) References Cited

U.S. PATENT DOCUMENTS

| | | | | |
|---|---|---|---|---|
| 2,406,704 | A | 8/1946 | Mossay et al. | |
| 4,912,618 | A | 3/1990 | Krinickas, Jr. | |
| 7,796,003 | B2 | 9/2010 | Hashino et al. | |
| 10,734,153 | B2 | 8/2020 | Maeda et al. | |
| 10,748,703 | B2 | 8/2020 | Shirouzu et al. | |
| 2009/0261939 | A1* | 10/2009 | Shudarek | H01F 3/10 336/212 |
| 2013/0187741 | A1* | 7/2013 | Goodrich | H01F 3/10 336/170 |
| 2015/0102882 | A1 | 4/2015 | Shudarek | |
| 2015/0244169 | A1 | 8/2015 | Kosugi et al. | |
| 2016/0125998 | A1* | 5/2016 | Bhide | H01F 37/00 336/5 |
| 2017/0040099 | A1* | 2/2017 | Bhide | H01F 27/245 |

FOREIGN PATENT DOCUMENTS

| | | | |
|---|---|---|---|
| CN | 201765902 | U | 3/2011 |
| DE | 102016010901 | A1 | 3/2017 |
| DE | 102017101156 | A1 | 8/2017 |
| JP | S49043123 | A | 4/1974 |
| JP | 4964861 | A | 6/1974 |
| JP | H03502279 | A | 5/1991 |
| JP | H 05-52650 | B | 8/1993 |

(Continued)

*Primary Examiner* — Ronald Hinson
(74) *Attorney, Agent, or Firm* — RatnerPrestia

(57) ABSTRACT

A transformer includes an outer peripheral iron core, and at least three iron core coils, which are in contact with or coupled to the inner surface of the outer peripheral iron core. The at least three iron core coils each include an iron core, and at least one of a primary coil and a secondary coil, which are wound around the iron core. Gaps, which can be magnetically coupled, are formed between two adjacent ones of the at least three iron cores, or between the at least three iron cores and a central iron core positioned at the center of the outer peripheral iron core.

19 Claims, 26 Drawing Sheets

(56) References Cited

FOREIGN PATENT DOCUMENTS

| | | | |
|---|---|---|---|
| JP | 2008177500 | A | 7/2008 |
| JP | 2009170620 | A | 7/2009 |
| JP | 2010252539 | A | 11/2010 |
| JP | 4-646327 | B | 3/2011 |
| JP | 2013-42028 | A | 2/2013 |
| JP | 5-701120 | B | 4/2015 |
| JP | 2015159675 | A | 9/2015 |
| JP | 2016122830 | A | 7/2016 |
| JP | 2017059805 | A | 3/2017 |
| WO | 2010119324 | A2 | 10/2010 |
| WO | 2015142354 | A1 | 9/2015 |

* cited by examiner

TRANSFORMER INCLUDING GAPS

CROSS-REFERENCE TO RELATED APPLICATIONS

This application is a new U.S. patent application that claims benefit of Japanese Patent Application No. 2016-249312, filed Dec. 22, 2016, the disclosure of this application is being incorporated herein by reference in its entirety for all purposes.

BACKGROUND OF THE INVENTION

1. Field of the Invention

The present invention relates to a transformer including gaps.

2. Description of the Related Art

Conventional transformers include U-shaped or E-shaped iron cores having a plurality of legs, and coils wound around such iron cores. The coils are exposed to the outside of a transformer, and a magnetic flux leaking from the coil generates an eddy current at a metal portion in the vicinity of the coils. This causes a problem in which the metal portion of the transformer produces heat. In an oil-filled transformer, a transformer is contained in a metal storage container, and accordingly, it is necessary to prevent heat from occurring in the metal storage container due to the magnetic flux leaking from the coils.

In order to solve such a problem, in Japanese Examined Patent Publication (Kokoku) No. 5-52650, a shield plate is disposed around the coil, and, in Japanese Patent No. 5701120, a shield plate is bonded to the inside of a storage container. This prevents the metal portion in the vicinity of the coil or the storage container from generating heat.

In conventional three-phase transformers including E-shaped iron cores, the magnetic path length of a central phase is different from the magnetic path lengths of both end phases. Thus, it is necessary to adjust the balance of the three phases by differentiating the number of turns in the central phase from the number of turns in both end phases.

In this respect, Japanese Patent No. 4646327 and Japanese Unexamined Patent Publication (Kokai) No. 2013-42028 disclose a three-phase electromagnetic device provided with main windings wound around a plurality of radially arranged magnetic cores, and control windings wound around a magnetic core connecting the plurality of magnetic cores. In such a case, the balance of the three phases can be adjusted.

SUMMARY OF THE INVENTION

However, in Japanese Patent No. 4646327 and Japanese Unexamined Patent Publication (Kokai) No. 2013-42028, the control windings are located at the outermost portion of the electromagnetic device, and accordingly, the magnetic flux of the control windings may leak to the outside. Further, it is necessary to provide the control winding in addition to the main windings, and accordingly, the size of the electromagnetic device may be increased.

Further, in a converter transformer, a given number of legs, around which direct-current side windings and alternate-current side windings are wound, are comprised of iron cores with gaps. Thyristors are independently connected to the corresponding direct-current side windings. The alternate-current side windings are connected in series, and are connected to a power source. Such iron cores with gaps are used for a so-called series multiplex voltage source converter, and, regarding the responsiveness of their motion, the power source-side power factor, and the high-frequency wave, excellent properties can be obtained.

Regarding iron cores of a common transformer, the size of joint parts of cutoff plates of silicon steel sheets is reduced to reduce the magnetic resistance as well as the iron loss/exciting current and the oscillation noise. In contrast, regarding iron cores of a converter transformer, it is necessary to increase the magnetic resistance to a certain extent by forming gaps on the following two grounds.

(1) Slight gaps in the on-timing or discrepancies in control and differences in the impedance property of a circuit including a transformer in a thyristor generate a direct-current component current. When the DC current passes through the direct-current side winding, the direct-current biased magnetization occurs at an iron core, and then, the iron core is saturated. As a result, the exciting current increases, and the property of the device as a power conversion device is deteriorated, and additionally, the loss in the converter transformer increases, and the oscillation noise increases. It is difficult to completely prevent the occurrence of the direct-current biased magnetization. Thus, even if a DC current, which is approximately 1% of the rated current, passes, it is necessary to form appropriate gaps so as not to saturate the iron core.

(2) It is necessary to uniform the shared voltages of the alternate-current side windings connected in series, in order to maintain excellent motions of the device as a power conversion device. Thus, it is necessary to uniform the exciting impedance, i.e., the magnetic resistance between the phases in the converter transformer. If there are no gaps between the iron cores, variations in the magnetic property depending on the material of the iron cores, or non-uniform clearances between the joint parts of the cutoff plates make it difficult to make the magnetic resistance uniform. In contrast, if there are gaps between the iron cores, the variations in the exciting impedance can be reduced to several % or less by controlling the production of the device so that the lengths of the gaps are uniformed.

Further, the capacity of the transformer, which is necessary in a conventional power conversion device, is up to several tens of MVAs. Thus, even if the number of gaps per leg in the transformer is one, there is no problem because the thickness of each gap is merely several mm.

However, in a power conversion device in which the necessary capacity of the transformer is several hundreds of MVAs, the iron cores of the converter transformer are large, and accordingly, it is necessary to set the thickness of each gap at 10 mm or more. Consequently, the spread of the magnetic flux in a gap increases, and fringing magnetic flux components, which vertically enter an end face of the iron core, increase, and then, the local heating increases. Further, the magnetic energy accumulated in one gap increases, and the oscillation noise increases. Thus, it is very difficult to design/produce such a device as a real product. This is not economical.

The present invention was made in view of such circumstances and has an object to provide a transformer in which leakage of a magnetic flux to the circumference is prevented, and its size is not increased.

In order to achieve the above object, according to a first aspect of the invention, there is provided a transformer including an outer peripheral iron core, and at least three iron core coils, which are in contact with or coupled to the inner surface of the outer peripheral iron core. The at least three iron core coils each include an iron core, and at least one of a primary coil and a secondary coil, which are wound around the iron core. Gaps, which can be magnetically coupled, are formed between two adjacent ones of the at least three iron cores, or between the at least three iron cores and a central iron core positioned at the center of the outer peripheral iron core.

In the first aspect of the invention, the iron core coils each obtained by winding a winding around an iron core are disposed inside the outer peripheral iron core, and accordingly, the leakage flux from the winding to the circumference can be reduced. Further, providing a shield plate as in a conventional technology is not necessary, and a small transformer can be formed. Further, in a three-phase transformer, the magnetic path lengths of the three phases are structurally equal, and accordingly, the design and production can be easily performed. Furthermore, the ratio of the primary input voltage to the secondary output voltage is fixed, a control line is not necessary, and the size of the transformer can be further reduced.

These objects, features, and advantages of the present invention and other objects, features, and advantages will become further clearer from the detailed description of typical embodiments illustrated in the appended drawings.

DETAILED DESCRIPTION

Figure 1:
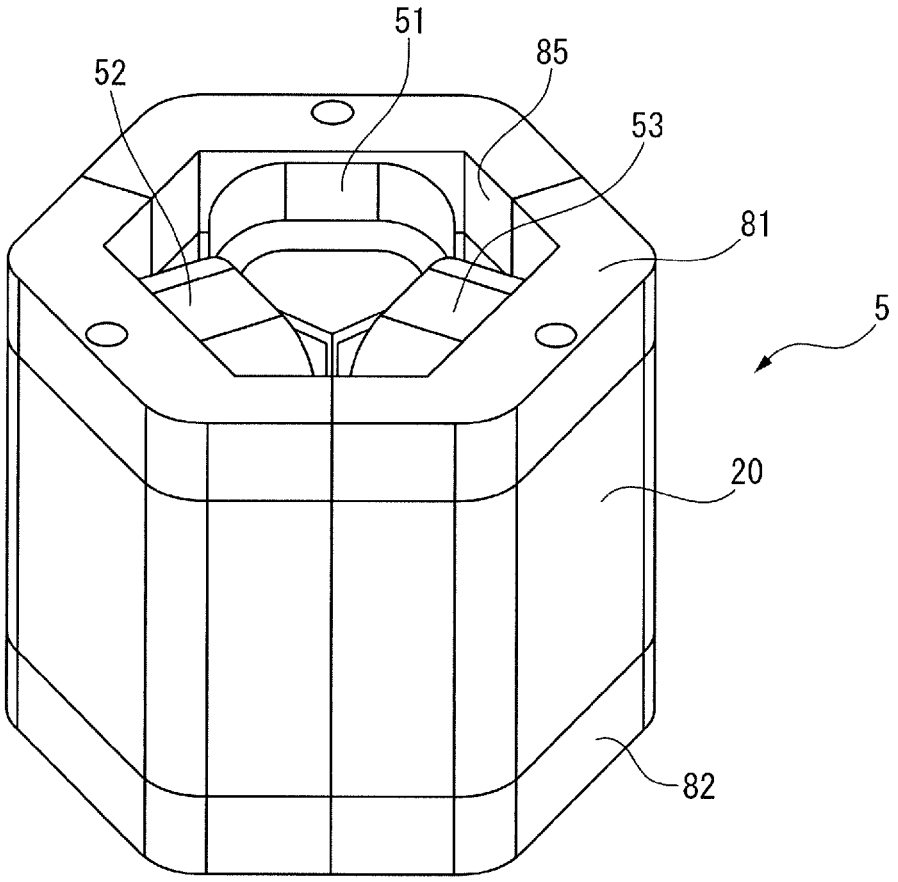
FIG. 1 is a perspective view of a transformer based on a first embodiment of the present invention.

Embodiments of the present invention will be described below with reference to the accompanying drawings. In the following figures, similar members are designated with the same reference numerals. These figures are properly modified in scale to assist the understanding thereof.

Figure 2A:
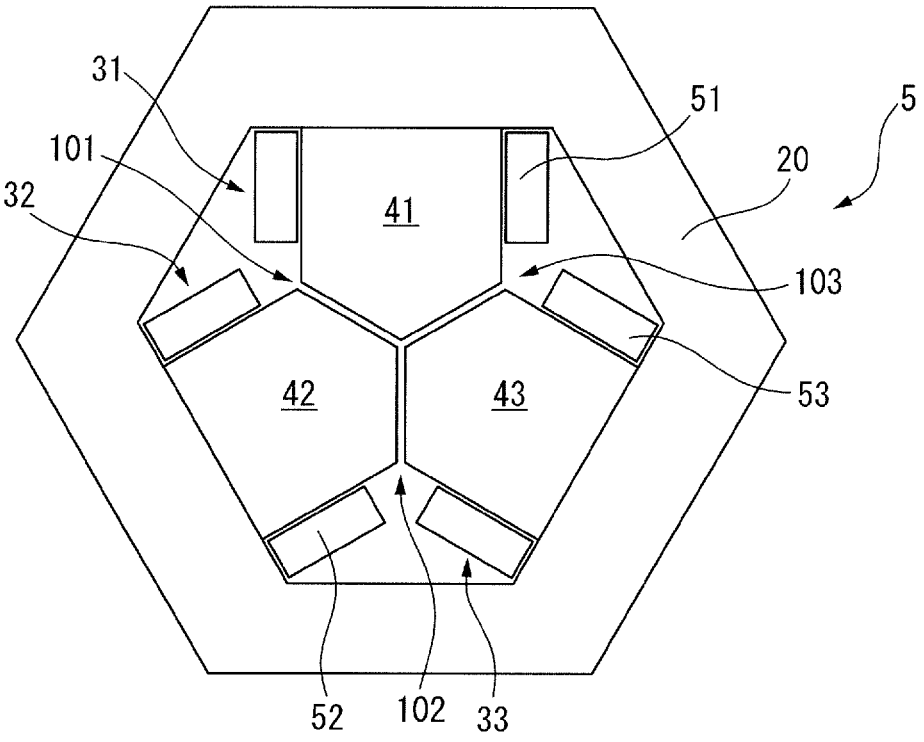
FIG. 2A is a sectional view of the transformer shown in FIG. 1.

FIG. 1 is a perspective view of a transformer based on a first embodiment of the present invention. FIG. 2A is a sectional view of the transformer shown in FIG. 1. As shown in FIG. 1, a transformer 5 includes an outer peripheral iron core 20 having a hexagonal section, and at least three iron core coils 31 to 33 which are in contact with or coupled to the inner surface of the outer peripheral iron core 20. Note that the outer peripheral iron core 20 may have a circular shape or another polygonal shape.

The iron core coils 31 to 33 respectively include iron cores 41 to 43, and coils 51 to 53 wound around the iron cores 41 to 43. Note that each of the coils 51 to 53 shown in, e.g., FIG. 1 and FIG. 2A can include both a primary coil and a secondary coil. The primary coil and the secondary coil may be wound around the same iron core so as to lap over one another, or may be alternately wound around the same iron core. Alternatively, the primary coil and the secondary coil may be wound around separate iron cores. Note that the outer peripheral iron core 20 and the iron cores 41 to 43 are made by stacking a plurality of iron plates, carbon steel plates, magnetic steel plates, or amorphous plates, or are made of a magnetic body, such as a dust core or ferrite.

As is clear from FIG. 2A, the iron cores 41 to 43 have the same dimensions, and are spaced at equal intervals in the circumferential direction of the outer peripheral iron core 20. In FIG. 2A, the radially outside ends of the iron cores 41 to 43 are in contact with the outer peripheral iron core 20.

Further, in FIG. 2A etc., the radially inside ends of the iron cores 41 to 43 converge on the center of the outer peripheral iron core 20, and the tip angle of each end is approximately 120 degrees. Further, the radially inside ends of iron cores 41 to 44 are spaced from one another via gaps 101 to 104 which can be magnetically coupled.

In other words, in the first embodiment, the radially inside end of the iron core 41 is spaced from the radially inside ends of the two adjacent iron cores 42 and 44 via the gaps 101 and 104. The same is true for the other iron cores 42 to 44. Note that it is ideal that the gaps 101 to 104 have the same dimensions, but it is acceptable that they have different dimensions. Further, in embodiments that will be described later, descriptions of, e.g., "gaps 101 to 104" and "iron core coils 31 to 34", are omitted in some cases.

As seen above, in the first embodiment, the iron core coils 31 to 33 are disposed inside the outer peripheral iron core 20. In other words, the iron core coils 31 to 33 are surrounded by the outer peripheral iron core 20. Thus, the leakage of the magnetic flux from the coils 51 to 53 to the outside of the outer peripheral iron core 20 can be reduced. In other words, the amount of reduction in the leakage flux is larger than that in a conventional technology, and accordingly, the magnetic flux, which does not leak, passes through the iron core. Thus, the ratio of the mutual inductance to the self-inductance increases, and accordingly, a lower-loss and more efficient transformer can be realized.

Alternatively, the transformer 5 shown in, e.g., FIG. 1 can be used as a three-phase transformer. In this case, the magnetic path lengths of the three phases are structurally equal, and accordingly, the design and production can be easily performed. Further, the ratio of primary input voltage to secondary output voltage is fixed, and accordingly, conventional control windings are not necessary. Thus, an increase in the size of the electromagnetic device 5 can be avoided.

Figure 2B:
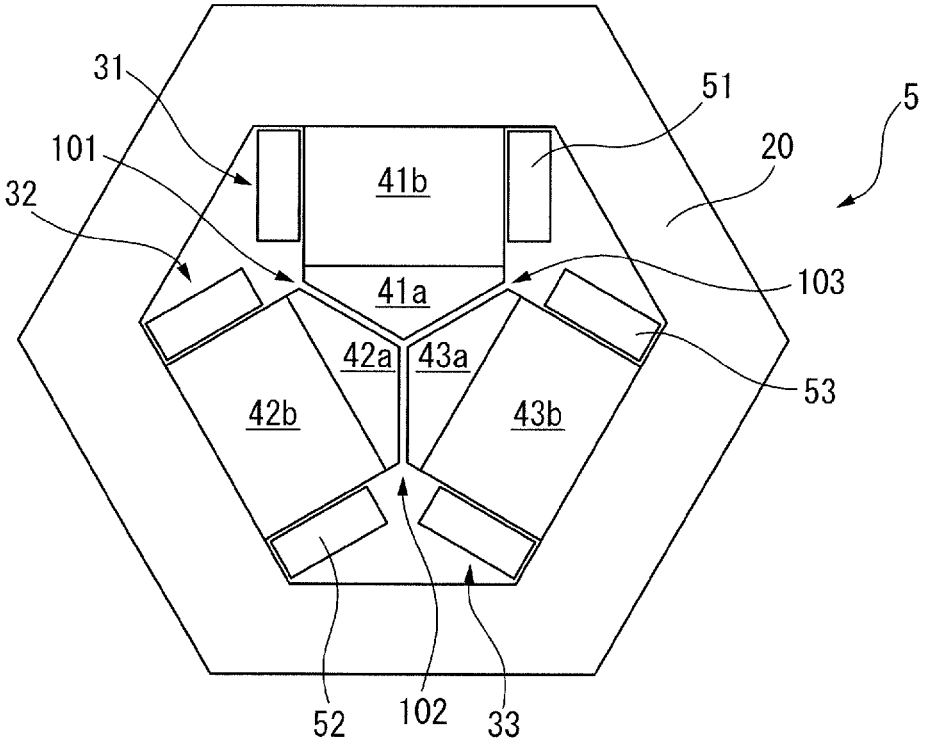
FIG. 2B is a sectional view of a transformer in a second embodiment.

Further, FIG. 2B is a sectional view of a transformer in a second embodiment. In FIG. 2B, the iron cores 41 to 43 are respectively comprised of tip side iron core portions 41*a* to 43*a* and base end side iron core portions 41*b* to 43*b*.

In this case, in a state where only the base end side iron core portions 41*b* to 43*b* are incorporated with the outer peripheral iron core 20, the coils 51 to 53 are wound around the base end side iron core portions 41*b* to 43*b*. Subsequently, the tip side iron core portions 41*a* to 43*a* are inserted as illustrated.

It will be understood that this causes the coils 51 to 53 to be easily attached, and improves the assembling property. For this object, it is preferable that the coils 51 to 53 are not disposed in areas between the tip side iron core portions 41*a* to 43*a* and the base end side iron core portions 41*b* to 43*b*. Alternatively, each of the iron cores 41 to 43 may be formed from three or more iron core portions.

Note that it is preferable that the contact surfaces between the tip side iron core portions 41*a* to 43*a* and the base end side iron core portions 41*b* to 43*b*, and the contact surfaces between the base end side iron core portions 41*b* to 43*b* and the outer peripheral iron core 20 are finished by mirror finishing, or have a fitting structure. This prevents gaps from being formed between the tip side iron core portions 41*a* to 43*a* and the base end side iron core portions 41*b* to 43*b* and between the base end side iron core portions 41*b* to 43*b* and the outer peripheral iron core 20.

Figure 3:
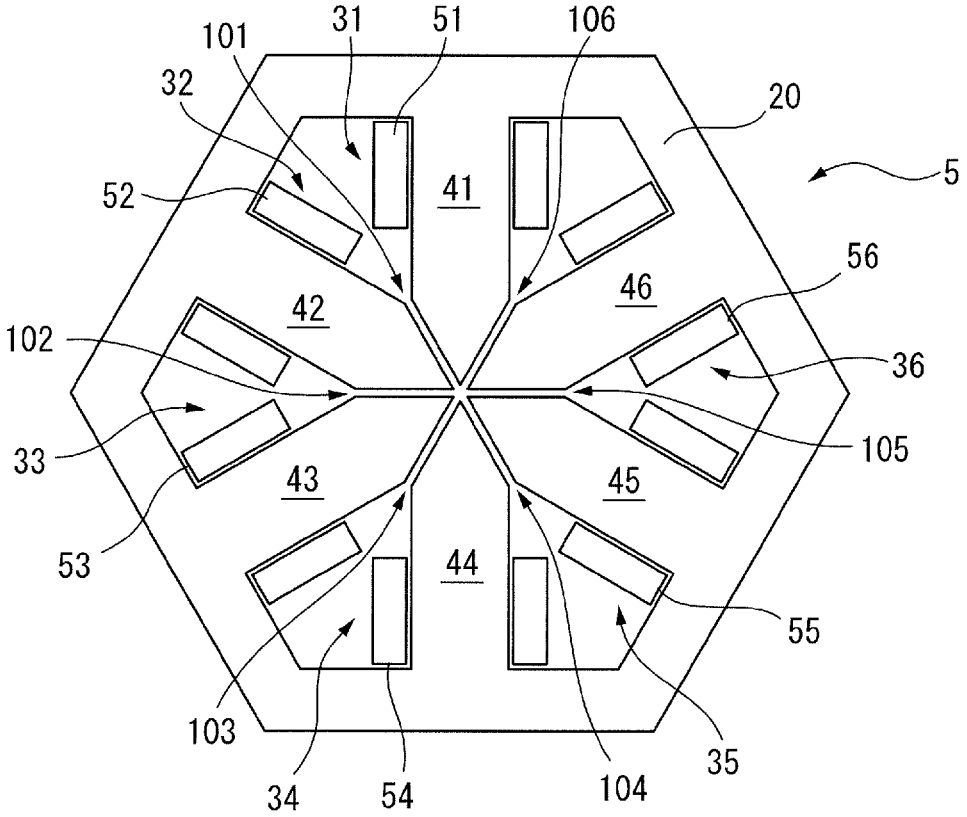
FIG. 3 is a sectional view of a transformer based on a third embodiment of the present invention.

FIG. 3 is a sectional view of a transformer based on a third embodiment of the present invention. The transformer 5 shown in FIG. 3 includes an outer peripheral iron core 20, and iron core coils 31 to 36 which are magnetically coupled to the outer peripheral iron core 20 and which are similar to the aforementioned iron core coils. The iron core coils 31 to 36 respectively include iron cores 41 to 46 and coils 51 to 56 wound around the iron cores.

The tip angle of the radially inside end of each of the iron cores 41 to 46 of the transformer 5 shown in FIG. 3 is approximately 60 degrees. Further, the radially inside ends of the iron cores 41 to 46 are spaced from one another via gaps 101 to 106 which can be magnetically coupled. As seen above, the transformer 5 may include the iron core coils 31 to 36, the number of which is a multiple of 3. In this case, the transformer 5 can be used as a three-phase transformer.

Figure 4:
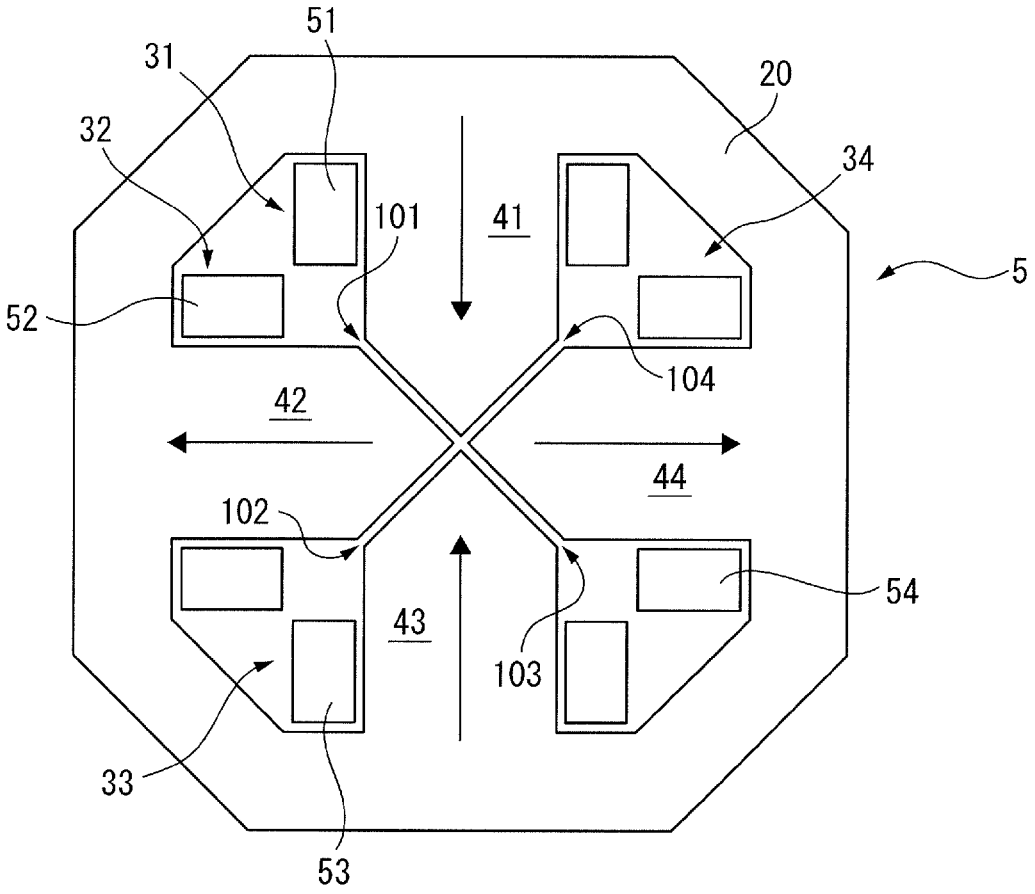
FIG. 4 is a sectional view of a transformer based on a fourth embodiment of the present invention.

FIG. 4 is a sectional view of a transformer based on a fourth embodiment of the present invention. As shown in FIG. 4, the transformer 5 includes an outer peripheral iron core 20 and four iron core coils 31 to 34 which are magnetically coupled to the outer peripheral iron core 20. In FIG. 4, the iron core coils 31 to 34 are disposed inside the outer peripheral iron core 20 having an octagon shape. Note that the outer peripheral iron core 20 may have a circular shape or another polygonal shape. The iron core coils 31 to 34 are spaced at equal intervals in the circumferential direction of the transformer 5. Not that it is only required that the iron core coils are arranged in the circumferential direction, and they do not have to be spaced at equal intervals.

As can be seen from FIG. 4, the iron core coils 31 to 34 respectively include iron cores 41 to 44, and coils 51 to 54 wound around the iron cores. The radially outside ends of the iron cores 41 to 44 are in contact with the outer peripheral iron core 20, or are integral with the outer peripheral iron core 20.

Further, the radially inside ends of the iron cores 41 to 44 are positioned in the vicinity of the center of the outer peripheral iron core 20. In, for example, FIG. 4, the radially inside ends of the iron cores 41 to 44 converge on the center of the outer peripheral iron core 20, and the tip angle of each end is approximately 90 degrees. Note that, as each tip angle decreases from 90 degrees, the area of each gap increases, but the magnetic flux saturation is easily caused by less current. Further, the radially inside ends of the iron cores 41 to 44 are spaced from one another via gaps 101 to 104 which can be magnetically coupled.

In other words, in the fourth embodiment, the radially inside end of the iron core 41 is spaced from the radially inside ends of the two adjacent iron cores 42 and 44 via the gaps 101 and 104. The same is true for the other iron cores 42 to 44. Note that it is ideal that the gaps 101 to 104 have the same dimensions, but it is acceptable that they have different dimensions. Further, in embodiments that will be described later, descriptions of, e.g., "gaps 101 to 104" and "iron core coils 31 to 34", are omitted in some cases.

Thus, as shown in FIG. 4, a single X-shaped gap comprised of the gaps 101 to 104 is formed at the center of the transformer 5. The gaps 101 to 104 are spaced at equal intervals in the circumferential direction of the transformer 5.

As seen above, in the fourth embodiment, a central iron core, which is positioned at the center of the transformer 5, is not necessary, and accordingly, the transformer 5, which has a light weight and a simple structure, can be obtained. Further, the four iron core coils 31 to 34 are surrounded by the outer peripheral iron core 20, and accordingly, magnetic fields, which have occurred from the coils 51 to 54, do not leak to the outside of the outer peripheral iron core 20. Further, the gaps 101 to 104 having a given thickness can be provided at a low cost. Thus, this transformer is advantageous in design to a transformer having a conventional configuration.

Alternatively, the transformer 5 may include iron core coils, the number of which is an even number not less than 4. In this case, it will be understood that the transformer 5 can be used as a single-phase transformer. Further, connecting coils in series or in parallel enables the output voltage or the rated current to be adjusted.

Figure 5:
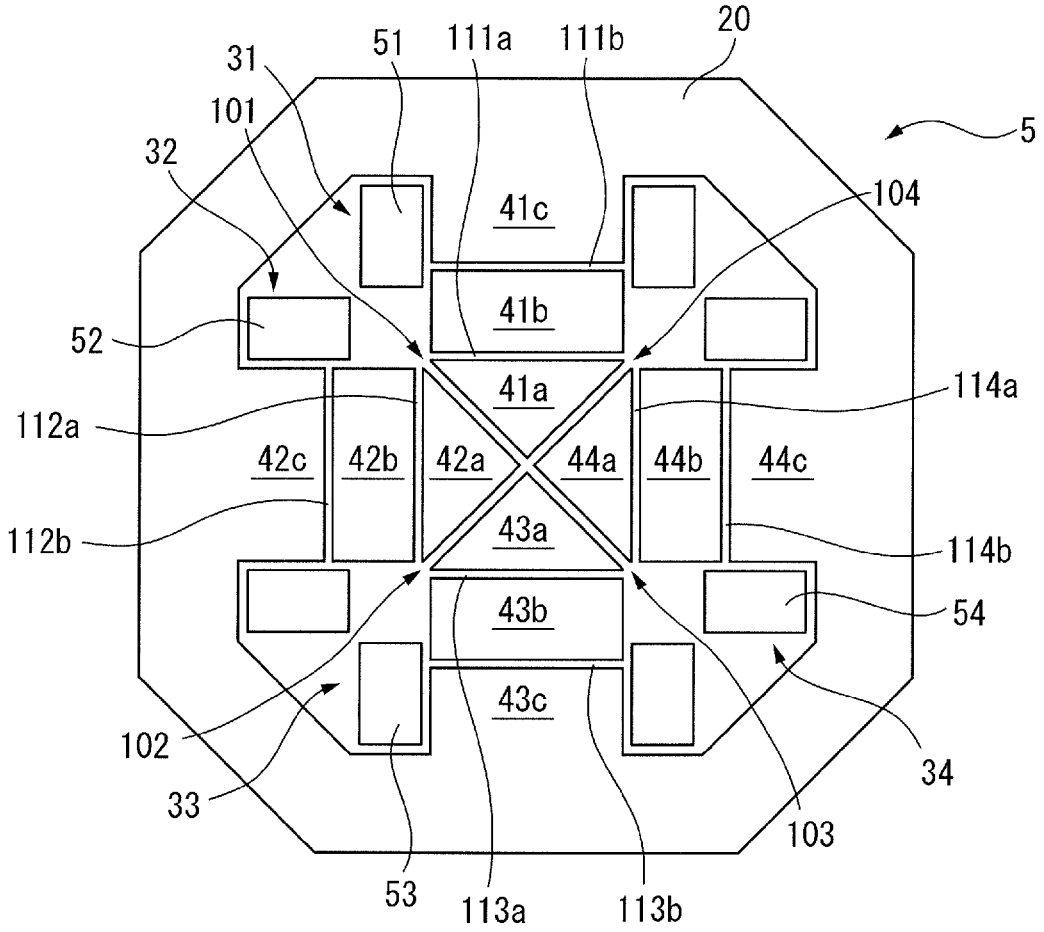
FIG. 5 is a sectional view of a transformer based on a fifth embodiment of the present invention.

FIG. 5 is a sectional view of a transformer based on a fifth embodiment of the present invention. The iron cores 41 to 44 extending in the radial directions of the iron core coils 31 to 34 in the transformer 5 shown in FIG. 5 respectively include first iron core portions 41*a* to 44*a* located at radially inside positions, third iron core portions 41*c* to 44*c* located at radially outside positions, and second iron core portions 41*b* to 44*b* located between the first iron core portions 41*a* to 44*a* and the third iron core portions 41*c* to 44*c*.

First iron core portion gaps 111*a* to 114*a*, which can be magnetically coupled, are formed between the first iron core portions 41*a* to 44*a* and the second iron core portions 41*b* to 44*b*. Likewise, second iron core portion gaps 111*b* to 114*b*, which can be magnetically coupled, are formed between the second iron core portions 41*b* to 44*b* and the third iron core portions 41*c* to 44*c*. Further, the transformer 5 includes coils 51 to 54 wound around both the second iron core portions 41*b* to 43*b* and the third iron core portions 41*c* to 44*c*. Note that the coils 51 to 54 may also be wound around the first iron core portions 41*a* to 44*a*.

In such a case, a gap, which is originally only the gap 101, for one iron core, e.g., the iron core 41 is divided into the gap 101, the first iron core portion gap 111*a*, and the second iron core portion gap 111*b*, and accordingly, the thickness of each gap reduces. The thickness of each gap in this case means a thickness of the gap 101 obtained by dividing the original gap, a distance between the first iron core portion 41*a* and the second iron core portion 41*b*, and a distance between the second iron core portion 41*b* and the third iron core portion 41*c*.

Figure 6:
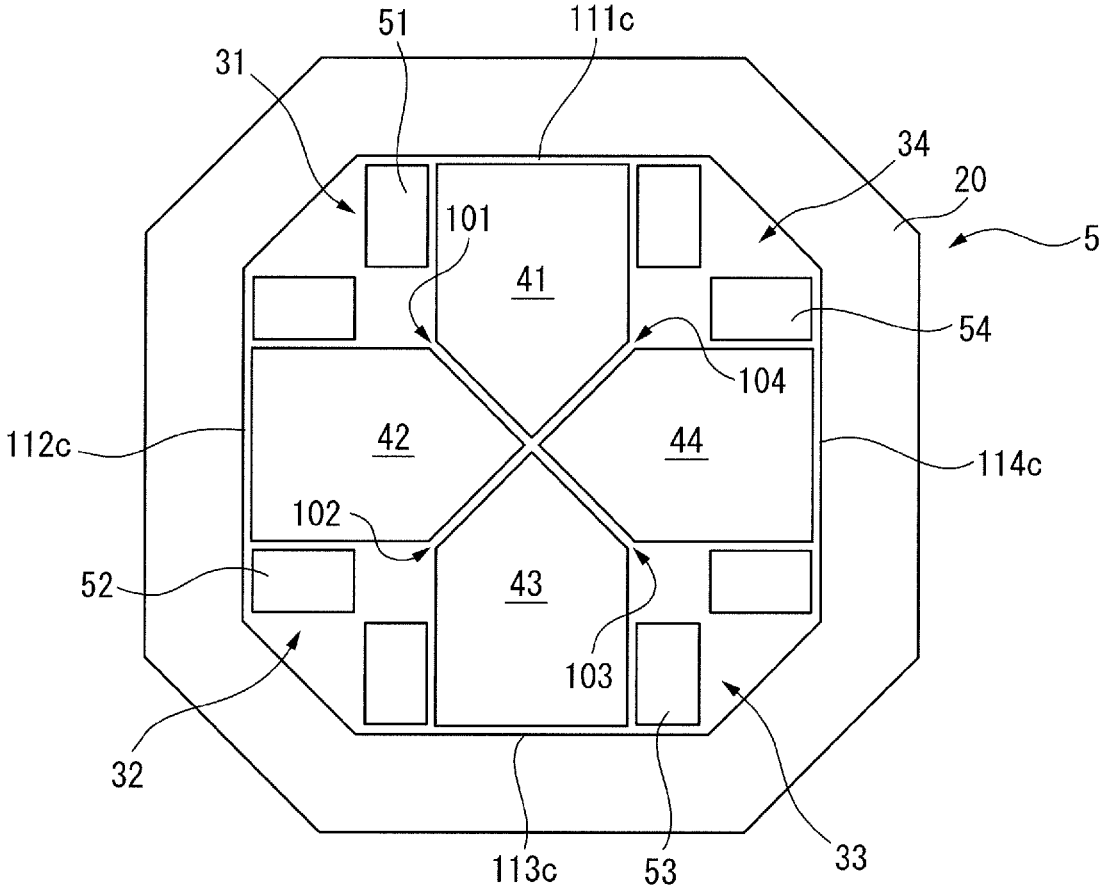
FIG. 6 is a sectional view of a transformer based on a sixth embodiment of the present invention.

FIG. 6 is a sectional view of a transformer based on a sixth embodiment of the present invention. The iron core coils 31 to 34 of the transformer 5 shown in FIG. 6 include iron cores 41 to 44 which radially extend, and coils 51 to 54 wound around the iron cores. The radially inside ends of the iron cores 41 to 44 are, as in the aforementioned embodiments, adjacent to one another via gaps 101 to 104.

In the sixth embodiment, outer peripheral iron core gaps 111*c* to 114*c*, which can be magnetically coupled, are respectively formed between the radially outside ends of the iron cores 41 to 44 and the outer peripheral iron core 20. When the transformer 5 operates, heat occurs at the iron core coils 31 to 34. In the sixth embodiment, the outer peripheral iron core gaps 111*c* to 114*c* are formed, and accordingly, the heat occurring from the iron core coils 31 to 34 is difficult to transfer to the outer peripheral iron core 20.

Figure 7:
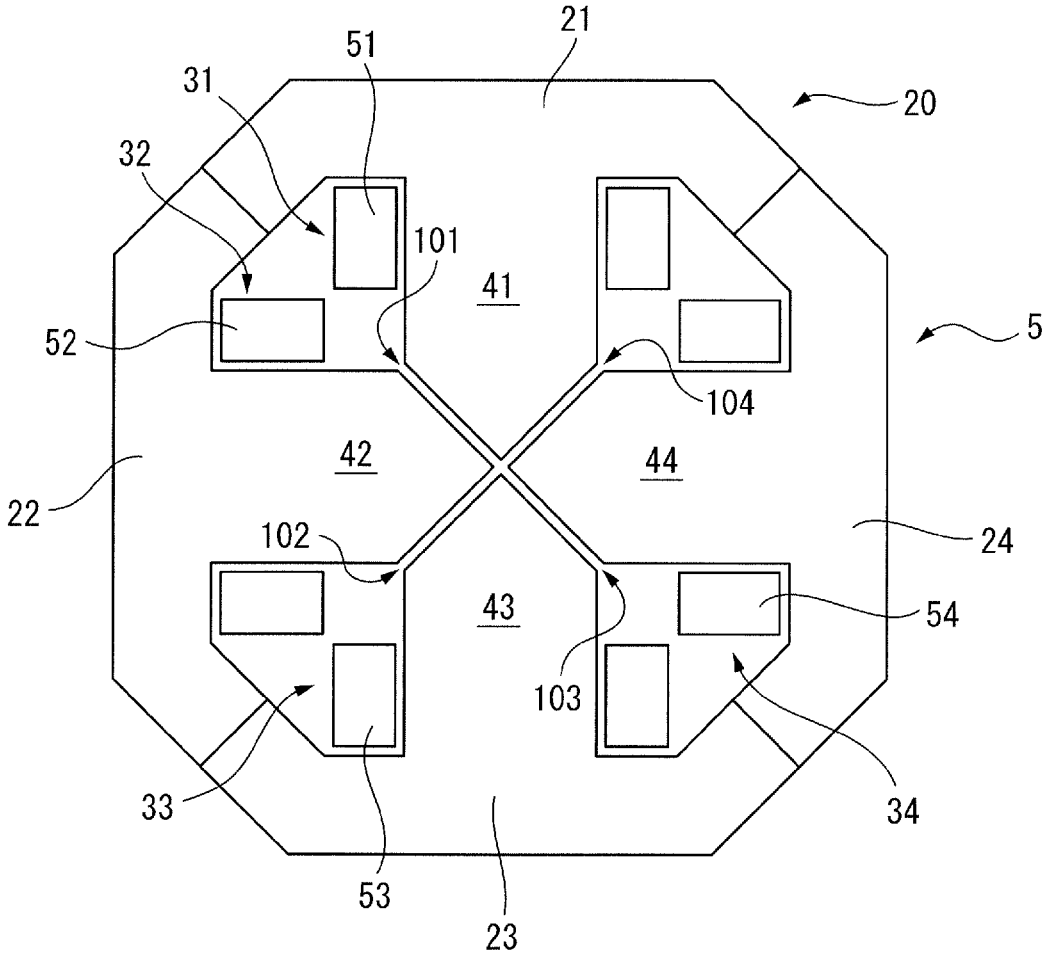
FIG. 7 is a sectional view of a transformer based on a seventh embodiment of the present invention.

FIG. 7 is a sectional view of a transformer based on a seventh embodiment of the present invention. The iron core coils 31 to 34 of the transformer 5 shown in FIG. 7 are substantially similar to the iron core coils which have been described with reference to FIG. 1. In the seventh embodiment, the outer peripheral iron core 20 is comprised of a plurality of, e.g., four outer peripheral iron core portions 21 to 24. In FIG. 7, the outer peripheral iron core portion 21 is in contact with or integral with the iron core 41. Likewise, the outer peripheral iron core portions 22 to 24 are respectively in contact with or integral with the iron cores 42 to 44. In the embodiment shown in FIG. 7, even if the outer peripheral iron core 20 is large, such an outer peripheral iron core 20 can be easily produced.

Figure 8:
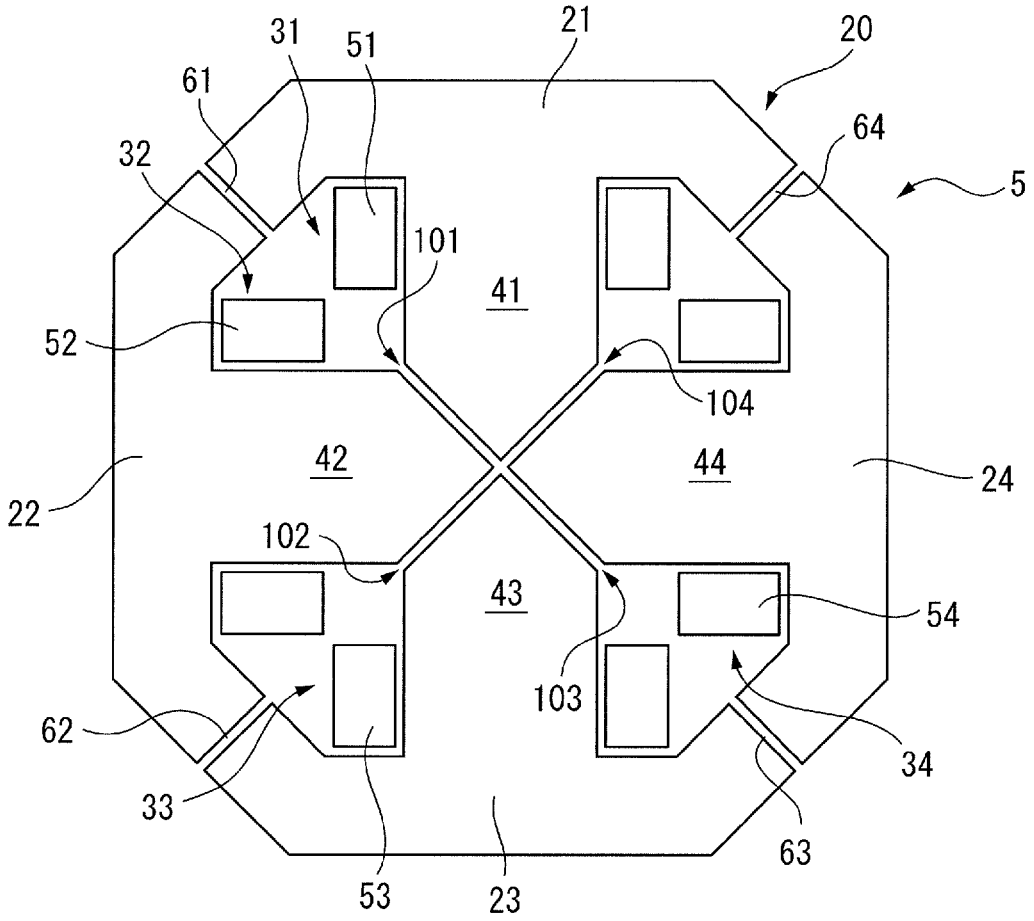
FIG. 8 is a sectional view of a transformer based on an eighth embodiment of the present invention.

FIG. 8 is a sectional view of a transformer based on an eighth embodiment of the present invention. In the eighth embodiment, an outer peripheral iron core portion gap 61, which can be magnetically coupled, is formed between the outer peripheral iron core portion 21 and the outer peripheral iron core portion 22. Likewise, outer peripheral iron core portion gaps 62 to 64, which can be magnetically coupled, are respectively formed between the outer peripheral iron core portion 22 and the outer peripheral iron core portion 23, between the outer peripheral iron core portion 23 and the outer peripheral iron core portion 24, and between the outer peripheral iron core portion 24 and the outer peripheral iron core portion 21.

In other words, the outer peripheral iron core portions 21 to 24 are respectively disposed via the outer peripheral iron core portion gaps 61 to 64. In such a case, the outer peripheral iron core portion gaps 61 to 64 can be adjusted by adjusting the lengths of the outer peripheral iron core portions 21 to 24. Consequently, it will be understood that the unbalance of the inductance of the transformer 5 can be adjusted.

The transformer 5 shown in FIG. 8 differs from the transformer 5 shown in FIG. 7 only in that it has outer peripheral iron core portion gaps 61 to 64. In other words, in this embodiment, the outer peripheral iron core portion gaps 61 to 64 are not formed between adjacent ones of the outer peripheral iron core portions 21 to 24. In the embodiments shown in FIG. 7 and FIG. 8, even if the outer peripheral iron core 20 is large, such an outer peripheral iron core 20 can be easily produced.

Figure 9:
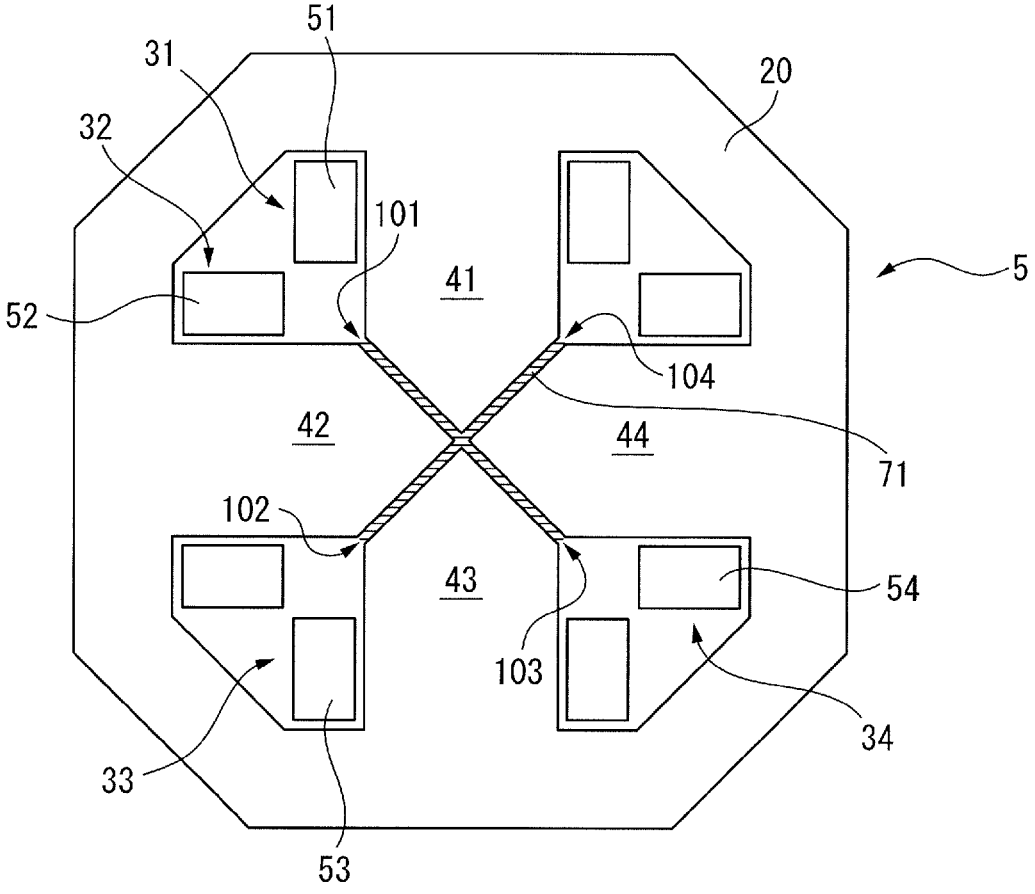
FIG. 9 is a sectional view of a transformer based on a ninth embodiment of the present invention.

FIG. 9 is a sectional view of a transformer based on a ninth embodiment of the present invention. The transformer 5 shown in FIG. 9 is substantially similar to the transformer 5 which has been described with reference to FIG. 4, and accordingly, the explanation thereof is omitted. As shown in FIG. 9, a resin gap material 71 is charged into gaps 101 to 104 of the transformer 5.

In this case, the gap material 71 can be made by simply charging resin into the gaps 101 to 104 and curing the same. Thus, the gap material 71 can be easily made. Note that the gap material 71 may previously be made as a substantially X-shaped gap material similar to that shown in FIG. 9, or an L-shaped or plate-like gap material, in order to insert the previously made gap material to the gaps 101 to 104 in place of charging resin. In such a case, the gap material 71 reduces the oscillation of the iron cores being in contact with the gaps 101 to 104, and accordingly, can reduce noises occurring from the iron cores. Likewise, gap materials can be easily made by charging resin into the iron core portion gaps shown in FIG. 5 and the outer peripheral iron core gaps shown in FIG. 8, and accordingly, it will be obvious that similar effects can be obtained in these gaps.

Figure 10:
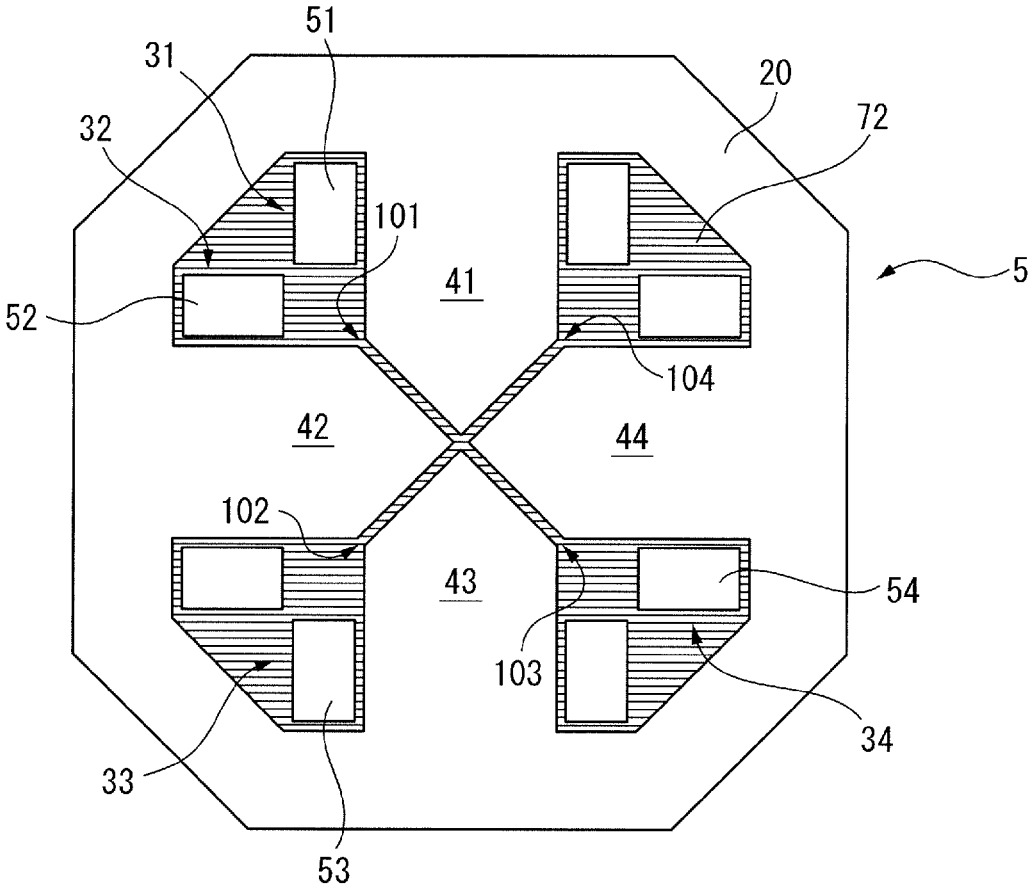
FIG. 10 is a sectional view of a transformer based on a tenth embodiment of the present invention.

FIG. 10 is a sectional view of a transformer based on a tenth embodiment of the present invention. The transformer 5 shown in FIG. 10 is substantially similar to the transformer 5 which has been described with reference to FIG. 4, and accordingly, the explanation thereof is omitted. As shown in FIG. 10, the inside of the outer peripheral iron core 20 of the transformer 5 is filled with a resin insulating material 72.

In this case, the insulating material 72 can be easily made by simply charging resin into the inside of the outer peripheral iron core 20 and curing the same. In such a case, the insulating material 72 can reduce the occurrence of noises by reducing the oscillation of the iron core coils 31 to 34 or the outer peripheral iron core 20. Further, in the embodiment shown in FIG. 10, the insulating material can also promote temperature equilibration between the iron core coils 31 to 34 and the outer peripheral iron core 20.

Figure 11:
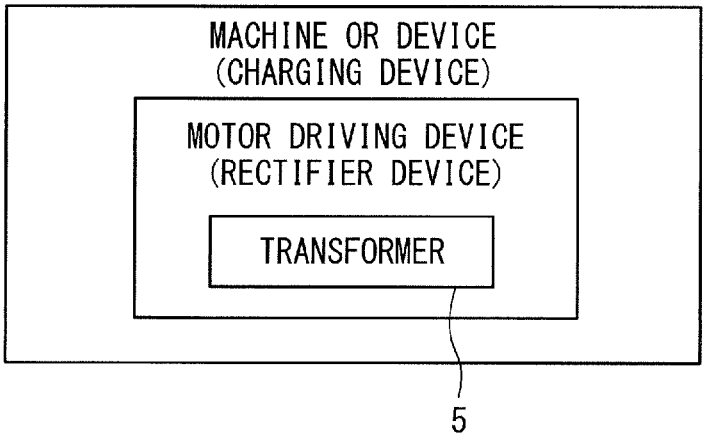
FIG. 11 is a view of a machine or device including a transformer of the present invention.

FIG. 11 is a view of a machine or device including the transformer of the present invention. In FIG. 11, the transformer 5 is used in a motor driving device. Such a motor driving device is included in a machine or device.

As can be seen from FIG. 11, the transformer 5 may be included in a rectifier device for converting direct current into alternating current in, e.g., photovoltaic generation. Such a rectifier device may be provided in a charging device, e.g., a charging device for vehicles. In such a case, it will be understood that the motor driving device, the rectifier device, the machine, the charging device, etc. which include the transformer 5 can easily be provided.

Figure 12:
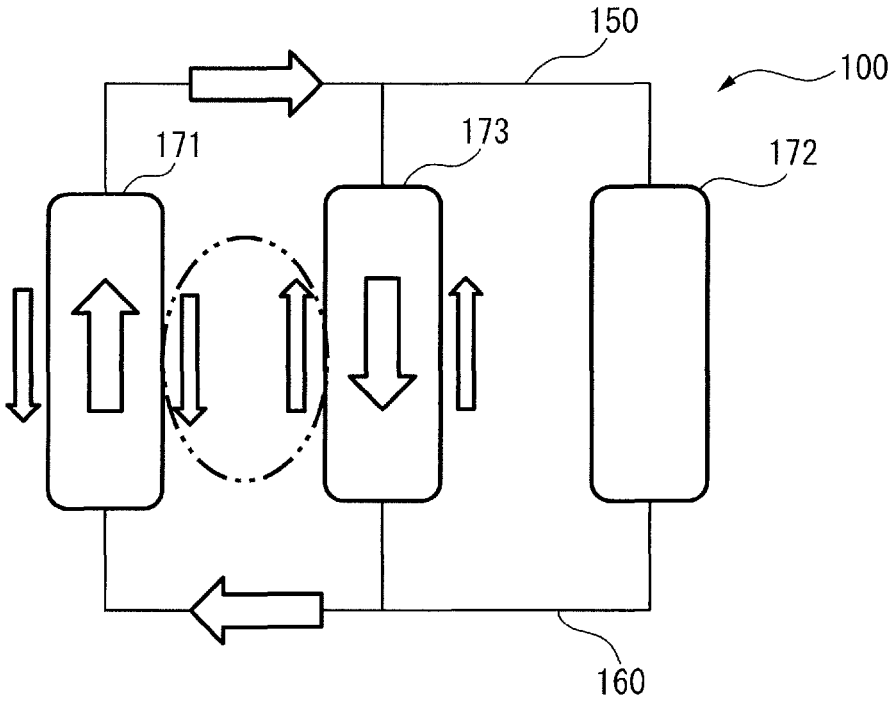
FIG. 12 is a schematic view of a conventional transformer.

FIG. 12 is a schematic view of a conventional transformer. In a transformer 100 shown in FIG. 12, coils 171 to 173 are disposed between two substantially E-shaped iron cores 150 and 160. Thus, the coils 171 to 173 are disposed in parallel with each other.

In FIG. 12, when a magnetic flux passes through two adjacent coils as designated by wide arrows, magnetic fluxes outside the coils act, as designated by narrow arrows, on each other so as to cancel each other. This increases the magnetic resistance, and thus, there is a tendency that the direct-current resistance value of the coils of the transformer 100 shown in FIG. 12 increases, and then, the loss increases.

Figure 13:
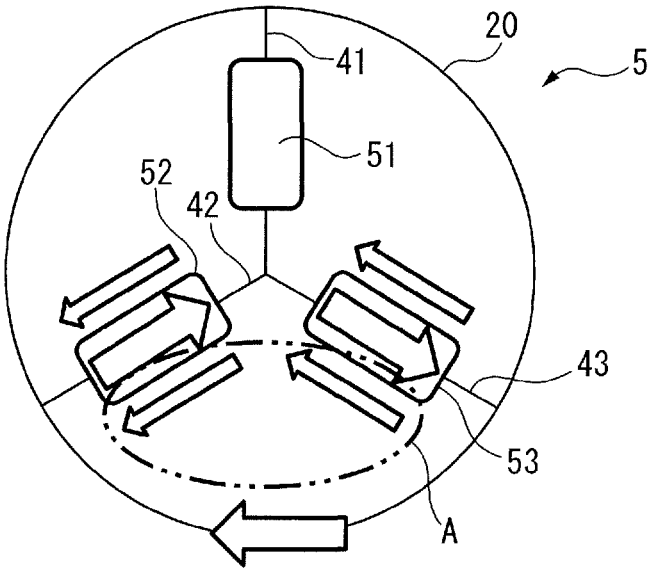
FIG. 13 is a schematic view of the transformer shown in FIG. 2A.

FIG. 13 is a schematic view of the transformer as shown in FIG. 2A. In this case, the two adjacent coils, e.g., coils 52 and 53 are not parallel to each other, and make an angle of approximately 120°. Thus, even if a magnetic flux passes through the two adjacent coils as designated by wide arrows, magnetic fluxes outside the coils do not cancel each other as designated by narrow arrows. Thus, in the transformer 5 of the present invention, the magnetic resistance does not increase. Thus, there is a tendency that the direct-current resistance values of the coils of the transformer 5 in the present invention do not largely increase, and an increase in the loss is small. It will be obvious that, as the angle between the two adjacent coils increases, the total loss does not needlessly increase without increasing the direct-current resistance values of the coils when the magnetic flux, which passes through the two adjacent coils, forms a closed magnetic path.

Figure 14:
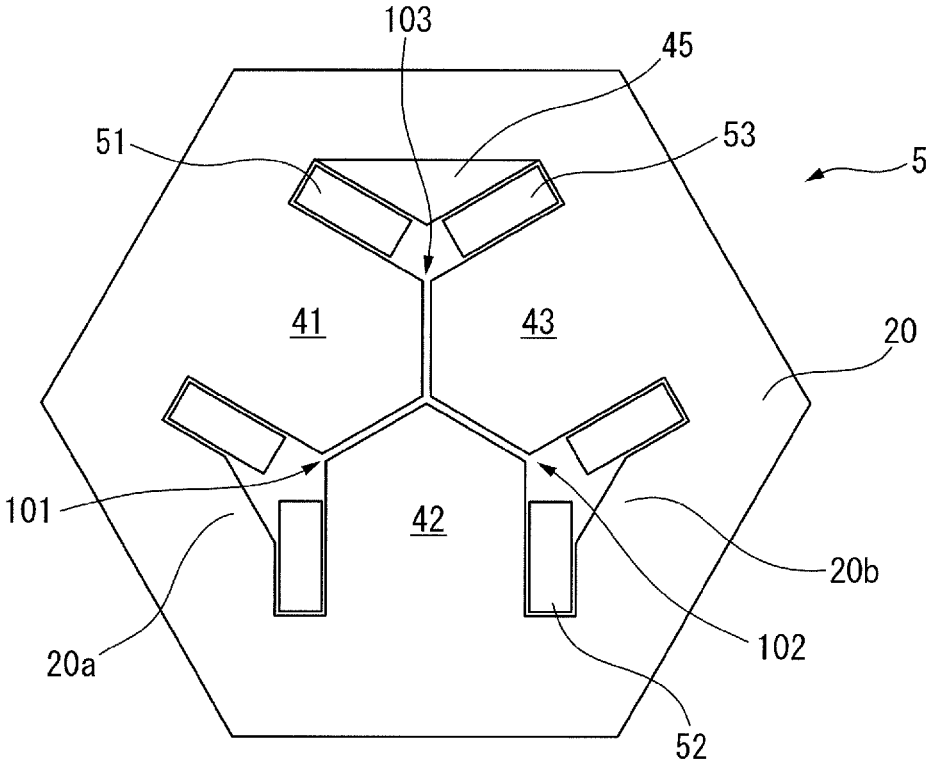
FIG. 14 is a sectional view of a transformer based on an eleventh embodiment of the present invention.

When an iron core is disposed between the two adjacent coils, an action for rectifying the flow of the magnetic fluxes occurring outside the coils is exerted, and accordingly, the direct-current resistance values of the coils can be further prevented from increasing. Thus, it is preferable to dispose an additional iron core in, e.g., an area A shown in FIG. 13. Here, FIG. 14 is a sectional view of a transformer based on an eleventh embodiment of the present invention. In FIG. 14, an additional iron core 45 having a section formed like an isosceles triangle is disposed at a place corresponding to the area A in FIG. 13. As illustrated, the sides of the cross-sectional surface of the additional iron core 45, which include a vertex angle, are larger than the thickness of the coils 51 and 53.

In FIG. 14, the coils 51 and 53 are in contact with the inner surface of the outer peripheral iron core 20. Thus, the coils 51 and 53 are surrounded by iron cores 41 and 43, the outer peripheral iron core 20, and the additional iron core 45. In other words, three sides of each of the cross-sectional surfaces of the coils 51 and 53 are adjacent to the iron cores 41 and 43, the outer peripheral iron core 20, and the additional iron core 45. In such a case, it will be understood that the aforementioned effect is high.

Further, in FIG. 14, protrusions 20*a* and 20*b* project radially inward from the inner surface of the outer peripheral iron core 20. The protrusions 20*a* and 20*b* respectively project between the coils 51 and 52 and between the coils 52 and 53. The cross-sectional surfaces of the protrusions 20*a* and 20*b* are formed like a substantial isosceles trapezoid, and the protrusions 20*a* and 20*b* are partially in contact with the outer surfaces of the coils 51 and 53.

As can be seen from FIG. 14, the protrusion 20*a* is in contact with the outer surfaces of the coils 51 and 52. The same is true in the protrusion 20*b*. Thus, in this case, two sides of the cross-sectional surface of each of the coils 51 and 53 are in fully contact with the corresponding one of the iron cores 41 and 43 and the outer peripheral iron core 20, and one side of the cross-sectional surface of each of the coils 51 and 53 is in partially contact with the corresponding one of the protrusions 20*a* and 20*b*. In this case, it will be understood that an effect substantially similar to the aforementioned effect can be obtained. Note that there may be minute clearances between the coils and the additional iron core 45 or the protrusion parts 20*a* and 20*b*.

In the transformer 5 shown in FIG. 14, the additional iron core 45 may be disposed in all areas between the coils 51 to 53. Alternatively, in the transformer 5 shown in FIG. 14, a protrusion similar to the aforementioned protrusions may be formed in all areas between the coils 51 to 53.

Figure 15:
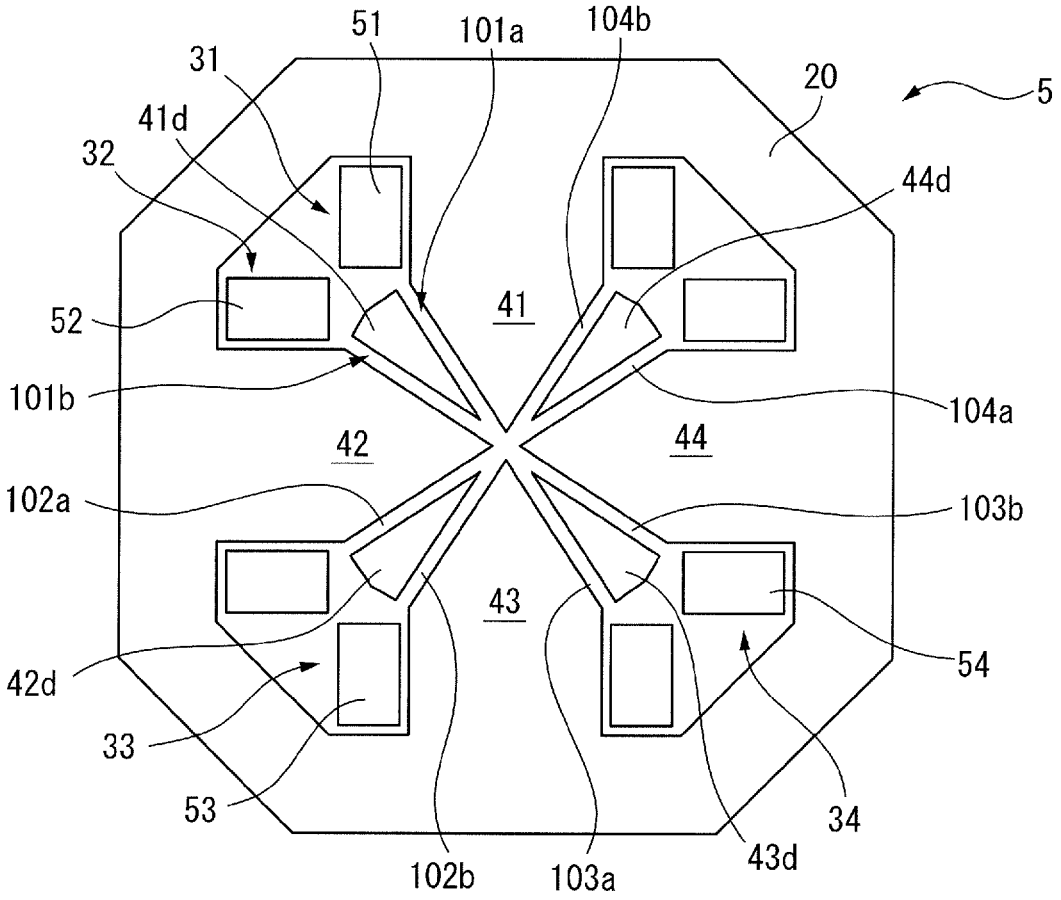
FIG. 15 is a sectional view of another transformer based on a twelfth embodiment of the present invention.

FIG. 15 is a sectional view of another transformer based on a twelfth embodiment of the present invention. In FIG. 15, additional iron cores 41*d* to 44*d* are disposed at the areas for the gaps 101 to 104 shown in FIG. 7. The cross-sectional surfaces of the additional iron cores 41*d* to 44*d* are shaped like a sector. Note that the cross-sectional surfaces of the additional iron cores 41*d* to 44*d* may be shaped like an isosceles triangle.

The radially inside ends of the iron cores 41 to 44 are each comprised of two apical surfaces. As shown in FIG. 15, the two flat surfaces of each of the additional iron cores 41*d* to 44*d* are parallel to the corresponding apical surfaces of the adjacent iron cores. Further, gaps 101*a* to 104*a* and 101*b* to 104*b*, which can be magnetically coupled, are formed between the flat surfaces of the additional iron cores 41*d* to 44*d* and the corresponding apical surfaces of the iron cores 41 to 44. Note that, it will be obvious that the angle between the two apical surfaces of each of the iron cores 41 to 44 in FIG. 15 is less than 60 degrees.

The number of gaps in FIG. 15 is eight, which is double the number of gaps shown in FIG. 7. Thus, the thickness of each gap, i.e., the distance between the flat surfaces of the additional iron cores 41*d* to 44*d* and the corresponding apical surfaces of the iron cores 41 to 44 can be reduced by half, and accordingly, the leakage flux can be reduced.

Figure 16:
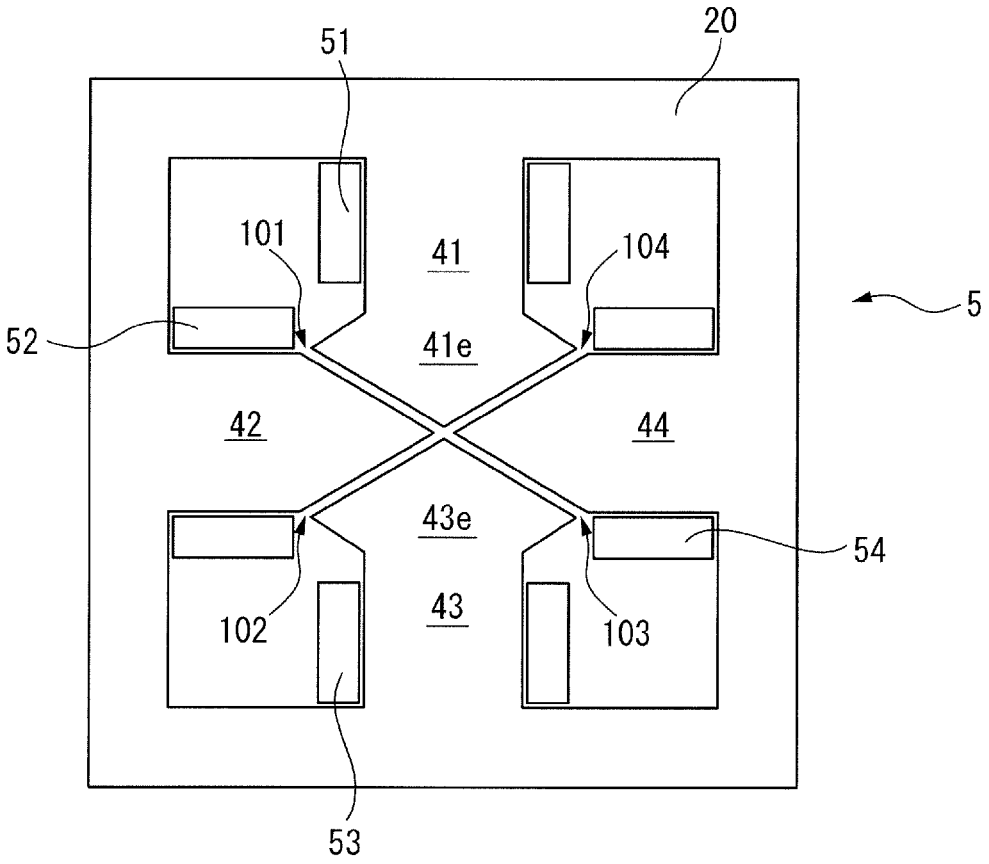
FIG. 16 is a sectional view of a transformer based on a thirteenth embodiment of the present invention.
Figure 17:
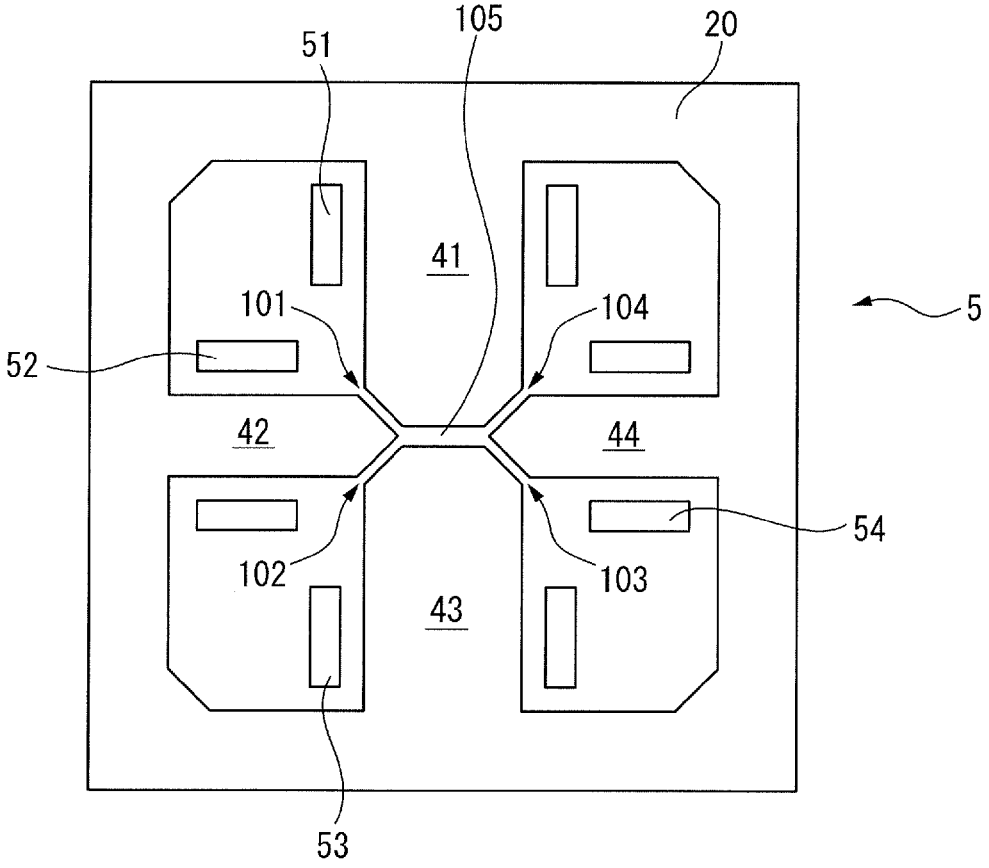
FIG. 17 is a sectional view of another transformer based on the thirteenth embodiment of the present invention.

FIG. 16 and FIG. 17 are sectional views of transformers based on a thirteenth embodiment of the present invention. FIG. 16 and FIG. 17 show substantially square transformers 5. As illustrated, iron cores 42 and 44, which are opposed to each other, have a shape similar to the aforementioned shape.

In contrast, at the tips of the other iron cores 41 and 43, wide portions 41*e* and 43*e*, which are wider than the main portions of the iron cores 41 and 43, are provided. The shape of the wide portions 41*e* and 43*e* corresponds to a part of a rhombus. However, the wide portions 41*e* and 43*e* may have another shape.

As illustrated, gaps 101 to 104, which can be magnetically coupled, are formed between the wide portions 41*e* and 43*e* of the iron cores 41 and 43 and the iron cores 42 and 44. The total length of the gaps 101 to 104 shown in FIG. 16 is larger than the total length of the gaps of another transformer which has a similar shape having no wide portions. Thus, increasing the total length of gaps enables enhancement of the inductance.

In the transformer 5 shown in FIG. 17, iron cores 41 and 43, which are opposed to each other, are entirely wider than the other iron cores 42 and 44, which are opposed to each other. Thus, in FIG. 17, the tips of the opposed iron cores 41 and 43 are flat, and an additional gap 105 is formed between the iron cores 41 and 43.

Thus, the total length of the gaps 101 to 104 and the additional gap 105 of the transformer 5 shown in FIG. 17 is larger than the total length of the gaps of the transformer 5 in which the width of the iron cores 41 and 43 is similar to the width of the iron cores 42 and 44. Likewise, in this case, the inductance can be enhanced.

Figure 18:
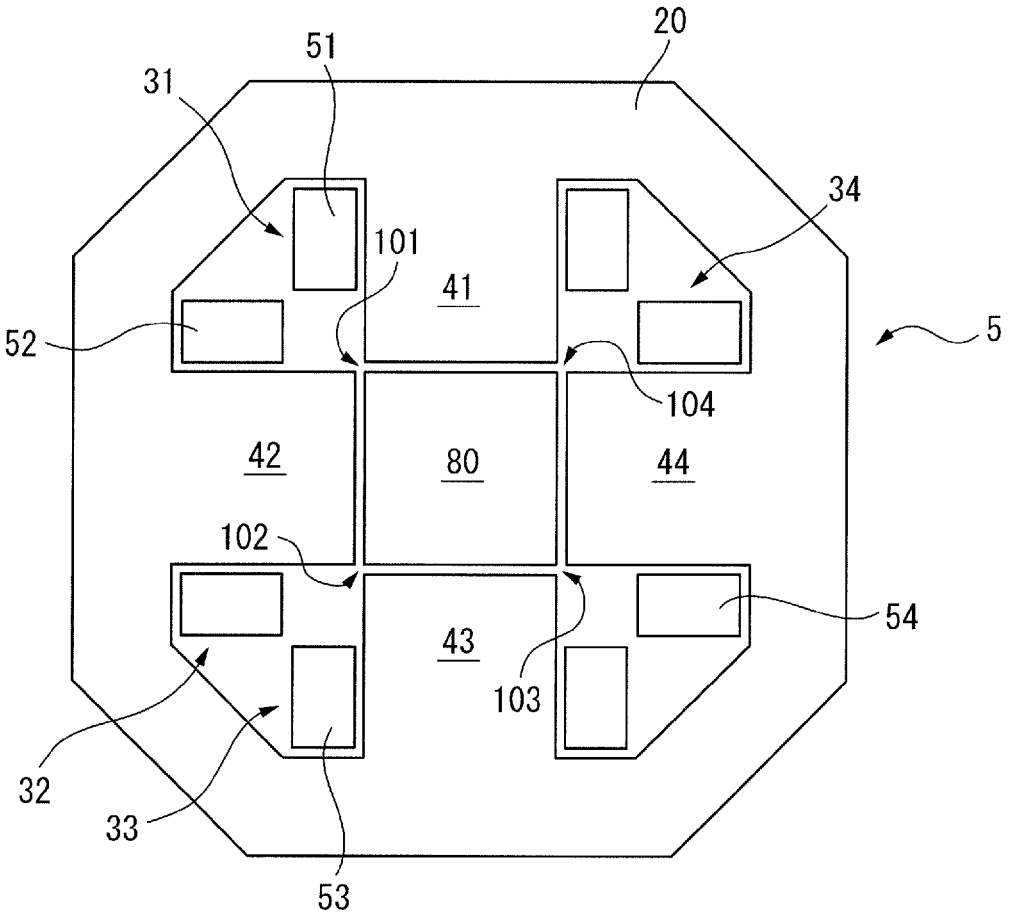
FIG. 18 is a sectional view of still another transformer of the present invention.

FIG. 18 is a sectional view of another transformer of the present invention. As shown in FIG. 18, the transformer 5 includes an outer peripheral iron core 20, and four iron core coils 31 to 34 which are magnetically coupled to the outer peripheral iron core 20. Further, a square central iron core 80 is disposed at the center of the transformer 5. Note that the central iron core 80 does not have to be square, and is preferably line-symmetric or rotationally symmetric. The iron core coils are only required to be circumferentially arranged, and do not necessarily have to be arranged at equal intervals.

As can be seen from FIG. 18, the iron core coils 31 to 34 respectively include iron cores 41 to 44 which radially extend, and coils 51 to 54 wound around the iron cores. The radially outside ends of the iron cores 41 to 44 are in contact with the outer peripheral iron core 20, or are integral with the outer peripheral iron core 20.

Further, the radially inside ends of the iron cores 41 to 44 are positioned in the vicinity of the center of the outer peripheral iron core 20. In FIG. 18, the radially inside ends of the iron cores 41 to 44 are flat. The radially inside ends of the iron cores 41 to 44 are adjacent to the central iron core 80 via gaps 101 to 104 which can be magnetically coupled. Note that the dimensions of the gaps 101 to 104 are identical to one another.

In this case, the four iron core coils 31 to 34 are surrounded by the outer peripheral iron core 20, and accordingly, magnetic fields occurring from the coils 51 to 54 do not leak to the outside of the outer peripheral iron core 20. Further, a transformer including a central iron core 80, which will be described later, has an effect substantially similar to the effect of the aforementioned transformers which have no central iron core 80.

The transformer shown in FIG. 18 and a transformer in another embodiment that will be described later have an effect that can adjust the inductance by changing the dimensions of the central iron core 80. In other words, the gaps 101 to 104 having a given thickness can be provided at a low cost. This is advantageous in design to transformers having a conventional configuration.

Figure 19:
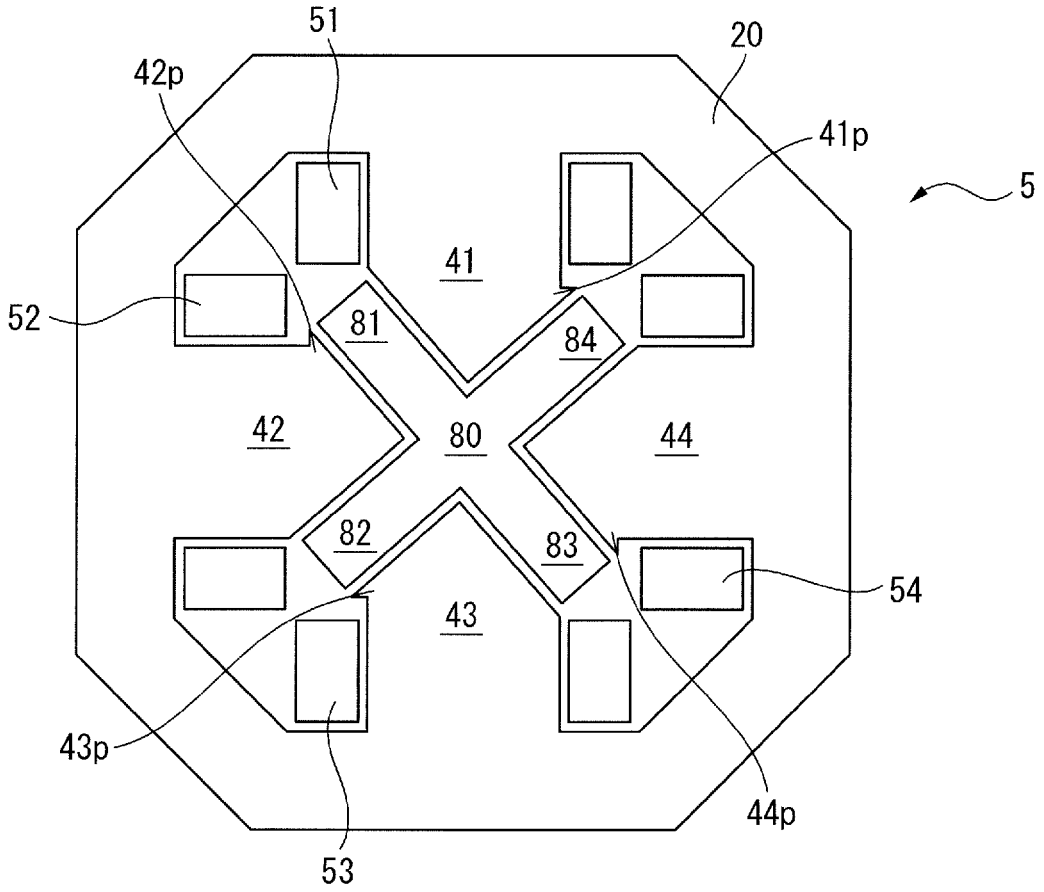
FIG. 19 is a sectional view of still another transformer of the present invention.

FIG. 19 is a sectional view of still another transformer of the present invention. In the following embodiment, an effect substantially similar to the effect of the transformer 5 shown in FIG. 18 can be obtained. The radially inside ends of the iron cores 41 to 44 of the transformer 5 shown in FIG. 19 converge on the center of the outer peripheral iron core 20, and the tip angle of each end is approximately 90 degrees.

Further, a central iron core 80 is disposed at the center of the transformer 5. As illustrated, the central iron core 80 has a substantially X-shape having four extensions 81 to 84. Further, the iron cores 41 to 44 respectively have, in the vicinity of their radially inside ends, substantially sector-shaped protrusions 41*p* to 44*p*, which clockwise extend. The protrusions 41*p* to 44*p* extend in areas between the end faces of adjacent coils in FIG. 1. The shape of the apical surfaces of the iron cores 41 to 44, to which the protrusions 41*p* to 44*p* are opposed, is configured to correspond to the protrusions 41*p* to 44*p*. Note that the protrusions 41*p* to 44*p* may counterclockwise extend.

Both side faces of each of the extensions 81 to 84 are adjacent to the corresponding radially inside ends of the iron cores 41 to 44. Further, gaps, which can be magnetically coupled, are formed between both side faces of the extensions 81 to 84 of the central iron core 80 and the iron cores 41 to 44. Thus, the total length of the gaps increases, and consequently, the inductance can be enhanced.

Figure 20:
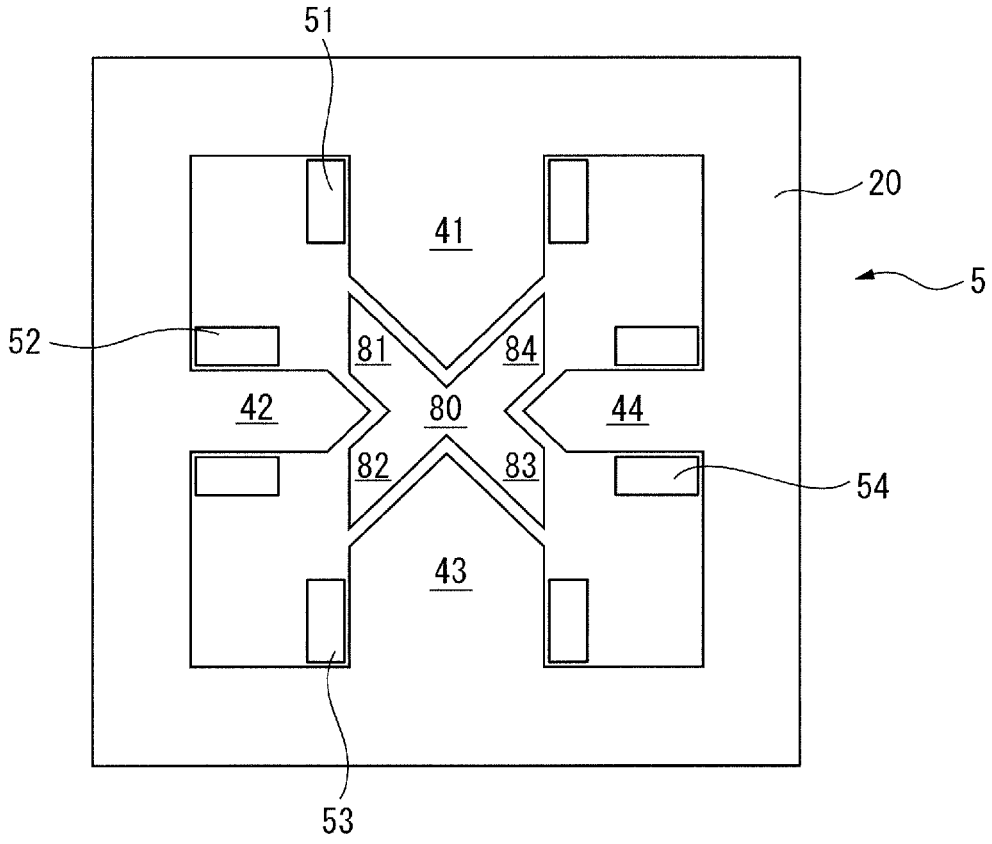
FIG. 20 is a sectional view of still another transformer of the present invention.

FIG. 20 is a sectional view of still another transformer of the present invention. The radially inside ends of the iron cores 41 to 44 converge on the center of the outer peripheral iron core 20, and the tip angle of each end is approximately 90 degrees. However, as illustrated, the iron cores 41 and 43 are wider than the other iron cores 42 and 44.

The transformer 5 shown in FIG. 20 includes a substantially X-shaped central iron core 80 having four extensions 81 to 84. The central iron core 80 is formed so that the radially inside ends of the iron cores 41 to 44 are received between two adjacent ones of the extensions 81 to 84. Further, gaps, which can be magnetically coupled, are formed between both side faces of the extensions 81 to 84 of the central iron core 80 and the iron cores 41 to 44. Thus, it will be understood that an effect similar to the aforementioned effect can be obtained.

Figure 21:
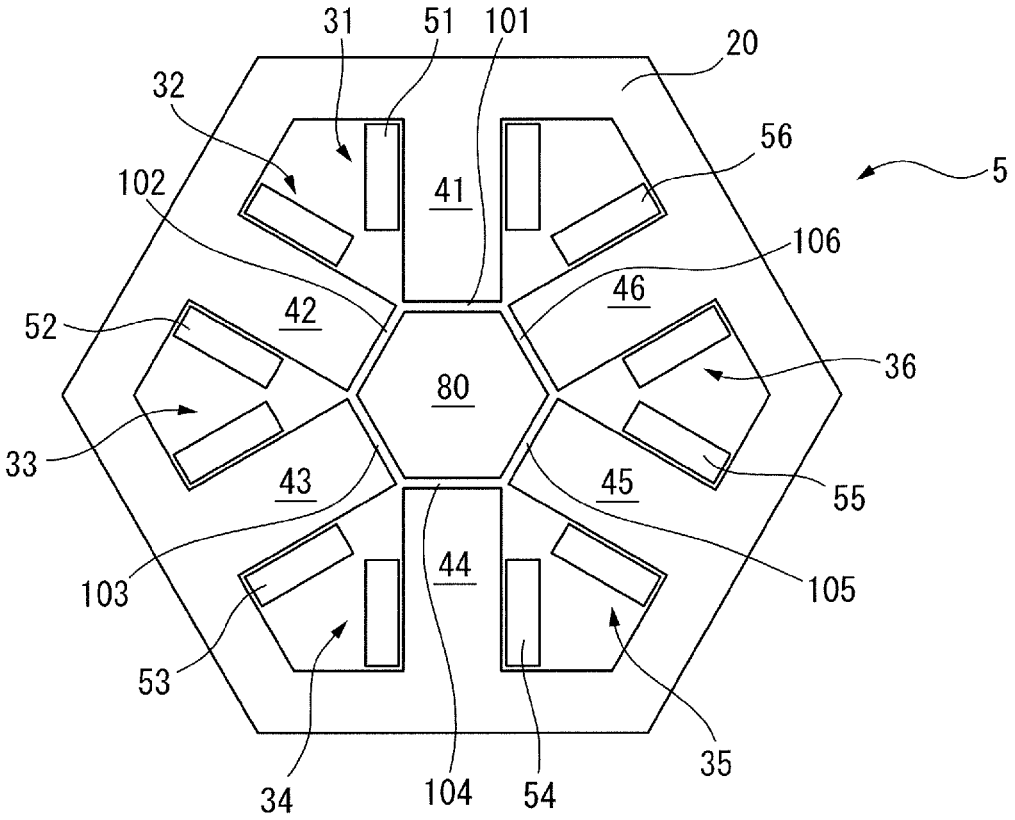
FIG. 21 is a sectional view of still another transformer of the present invention.

FIG. 21 is a sectional view of still another transformer of the present invention. The transformer 5 shown in FIG. 21 includes an outer peripheral iron core 20, a central iron core 80 having a substantially hexagonal shape, and iron core coils 31 to 36 similar to those described above. The iron core coils 31 to 36 respectively include iron cores 41 to 46, which radially extend, and coils 51 to 56 wound around the iron cores.

The radially inside ends of the iron cores 41 to 46 of the transformer 5 shown in FIG. 21 are flat. Further, the radially inside ends of the iron cores 41 to 46 are adjacent to the central iron core 80 via gaps 101 to 106 which can be magnetically coupled. As seen above, the transformer 5 may include iron core coils 31 to 36, the number of which is an even number not less than 6.

Figure 22:
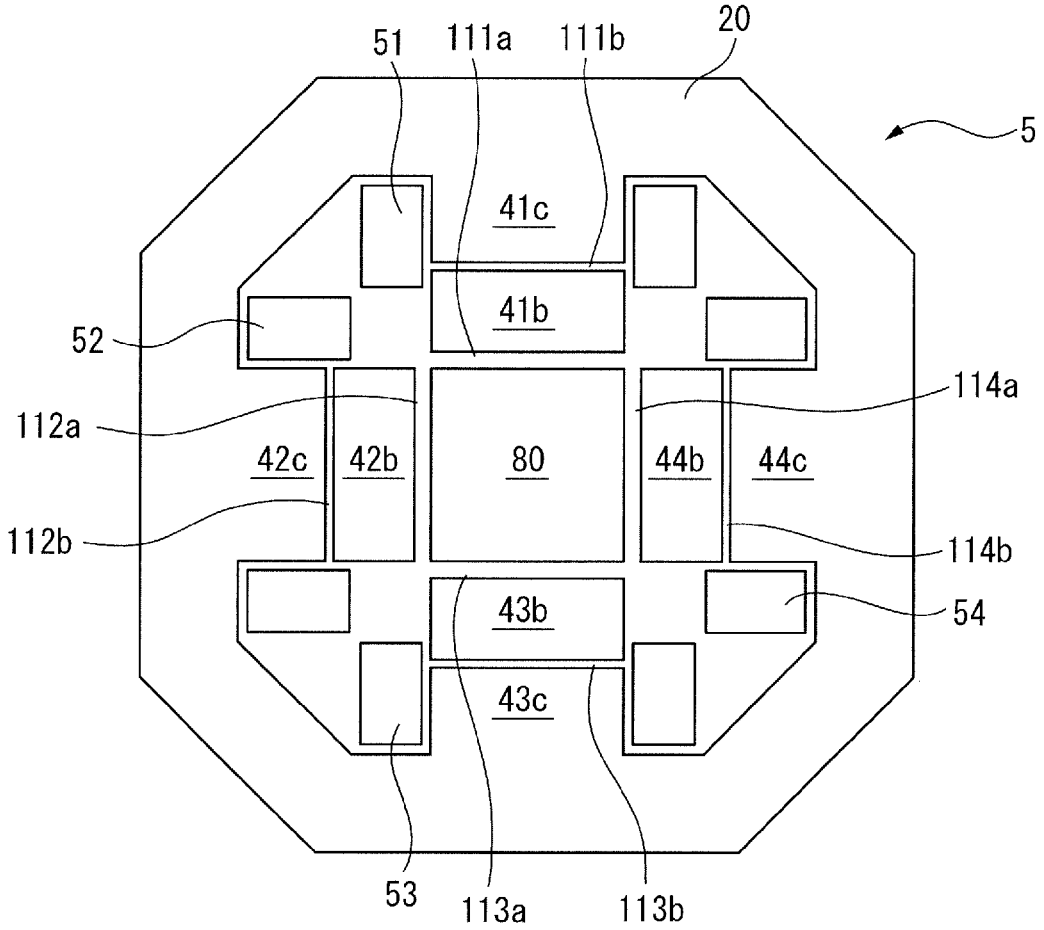
FIG. 22 is a sectional view of still another transformer of the present invention.

FIG. 22 is a sectional view of still another transformer of the present invention. The iron cores 41 to 44, which extend in the radial directions of the iron core coils 31 to 34 in the transformer 5 shown in FIG. 22, respectively include first iron core portions 41*a* to 44*a* positioned on the radially inside, and third iron core portions 41*c* to 44*c* positioned on the radially outside.

Iron core portion gaps 111*a* to 114*a*, which can be magnetically coupled, are formed between a central iron core 80 and first iron core portions 41*a* to 44*a*. Further, iron core portion gaps 111*b* to 114*b*, which can be magnetically coupled, are formed between the first iron core portions 41*a* to 44*a* and the third iron core portions 41*c* to 44*c*.

In such a case, for one iron core, e.g., the iron core 41, the first iron core portion gap 111*a* and the second iron core portion gap 111*b* are formed, and accordingly, the thickness of each gap is small. The thickness of each gap can be reduced, and accordingly, the leakage flux from each gap can be reduced. Further, the iron cores 41 to 44 are each comprised of a plurality of iron core portions, and accordingly, the transformer 5 can be easily assembled. The iron cores 41 to 44 may be each comprised of three or more iron core portions arranged in a line.

Figure 23:
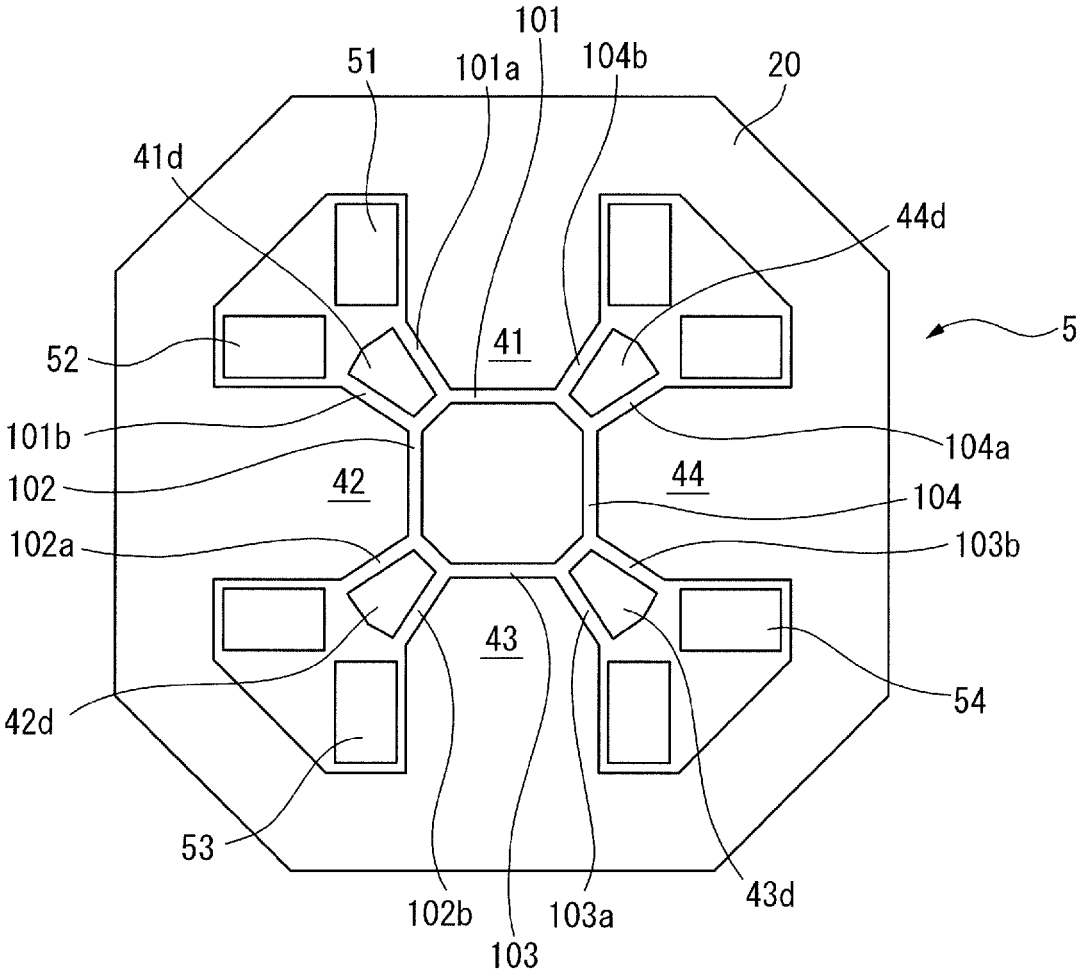
FIG. 23 is a sectional view of still another transformer of the present invention.

FIG. 23 is a sectional view of still another transformer of the present invention. In FIG. 23, additional iron cores 41*d* to 44*d* are each disposed between the corresponding two adjacent ones of iron cores 41 to 43. The cross-sectional surface of each of the additional iron cores 41*d* to 44*d* is a part of a sector. Note that the cross-sectional surface of each of the additional iron cores 41*d* to 44*d* may be a part of an isosceles triangle.

The radially inside ends of the iron cores 41 to 44 each include two apical surfaces and a flat surface between the two apical surfaces. As shown in FIG. 23, each of the two flat surfaces of each of the additional iron cores 41*d* to 44*d* is parallel to the corresponding apical surface of the adjacent iron core. Gaps 101*a* to 104*a* and 101*b* to 104*b*, which can be magnetically coupled, are formed between the flat surfaces of the additional iron cores 41*d* to 44*d* and the corresponding apical surfaces of the iron cores 41 to 44. Further, gaps 101 to 104, which can be magnetically coupled, are formed between the flat surfaces of the iron cores 41 to 44 and the central iron core 80. Further, gaps (having no reference numerals), which can be magnetically coupled, are formed between the tips of the additional iron cores 41*d* to 44*d* and the central iron core 80.

In FIG. 23, the total length of the gaps is increased, and accordingly, the inductance can be increased. Further, in this case, the thickness of each gap can be reduced, and accordingly, the leakage flux can be further reduced.

Figure 24:
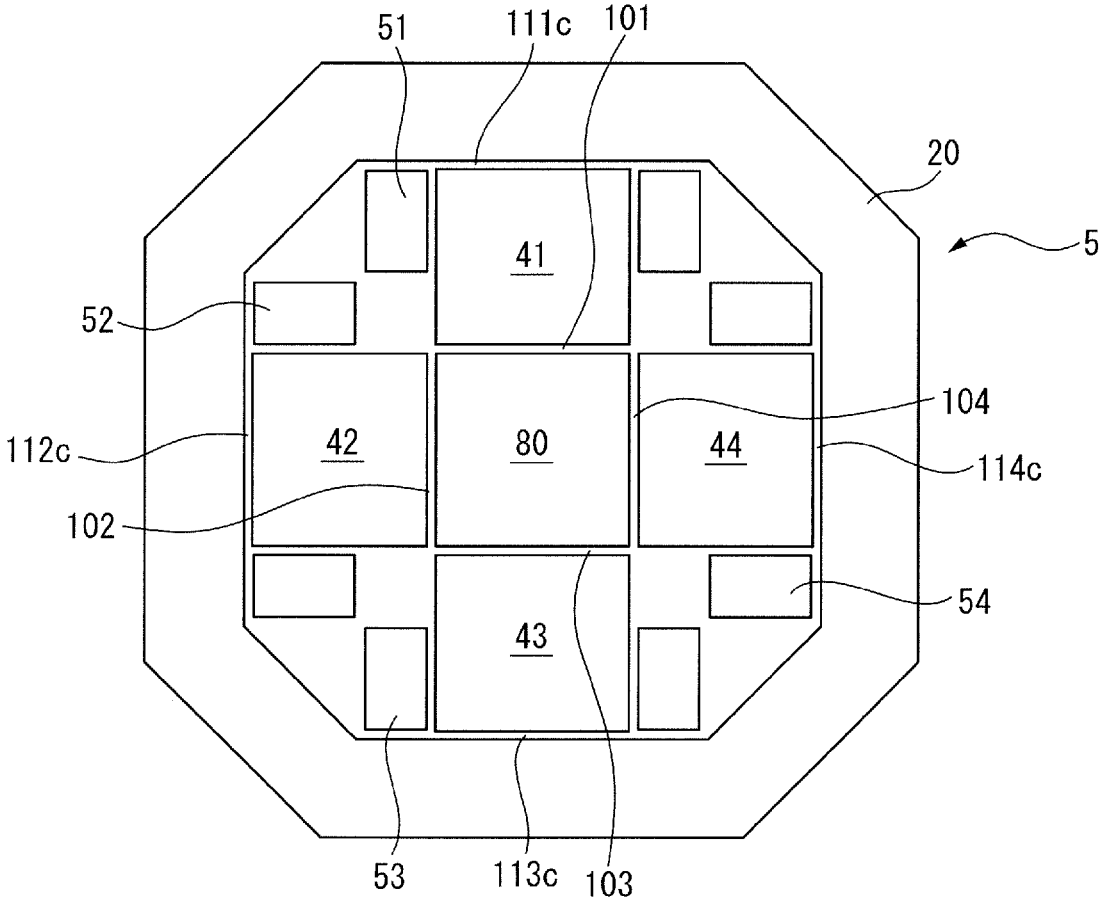
FIG. 24 is a sectional view of still another transformer of the present invention.

FIG. 24 is a sectional view of still another transformer of the present invention. In the transformer 5 shown in FIG. 24, outer peripheral iron core gaps 111*c* to 114*c*, which can be magnetically coupled, are respectively formed between the radially outside ends of iron cores 41 to 44 and an outer peripheral iron core 20. When the transformer 5 operates, heat occurs in the iron core coils 31 to 34. In this embodiment, the outer peripheral iron core gaps 111*c* to 114*c* are formed, and accordingly, the heat occurring from the iron core coils 31 to 34 is difficult to transfer to the outer peripheral iron core 20.

Figure 25:
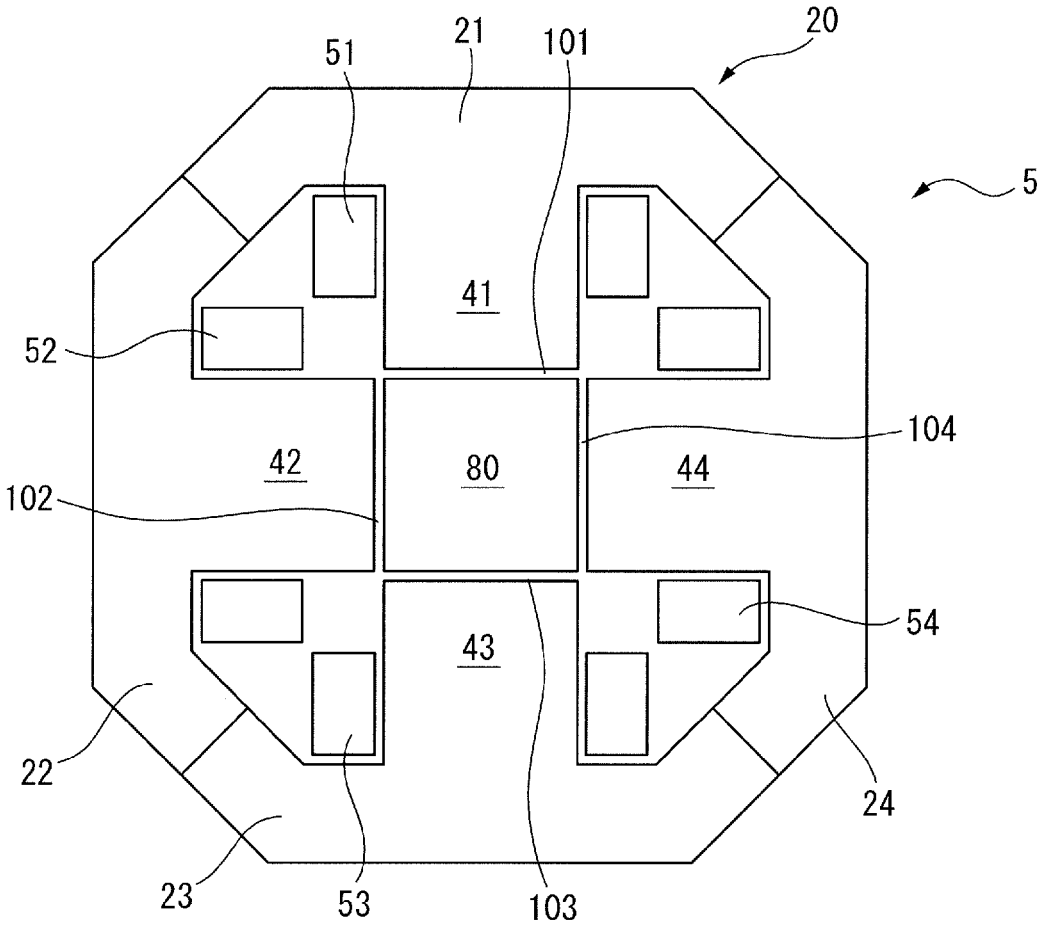
FIG. 25 is a sectional view of still another transformer of the present invention.

FIG. 25 is a sectional view of a transformer based on a sixth embodiment of the present invention. In the transformer 5 shown in FIG. 25, an outer peripheral iron core 20 is comprised of a plurality of, e.g., four outer peripheral iron core portions 21 to 24. In FIG. 25, the outer peripheral iron core portion 21 is in contact with or integral with an iron core 41. Likewise, the outer peripheral iron core portions 22 to 24 are respectively in contact with or integral with iron cores 42 to 44. In the embodiment shown in FIG. 25, even if the outer peripheral iron core 20 is large, such an outer peripheral iron core 20 can be easily produced.

Figure 26:
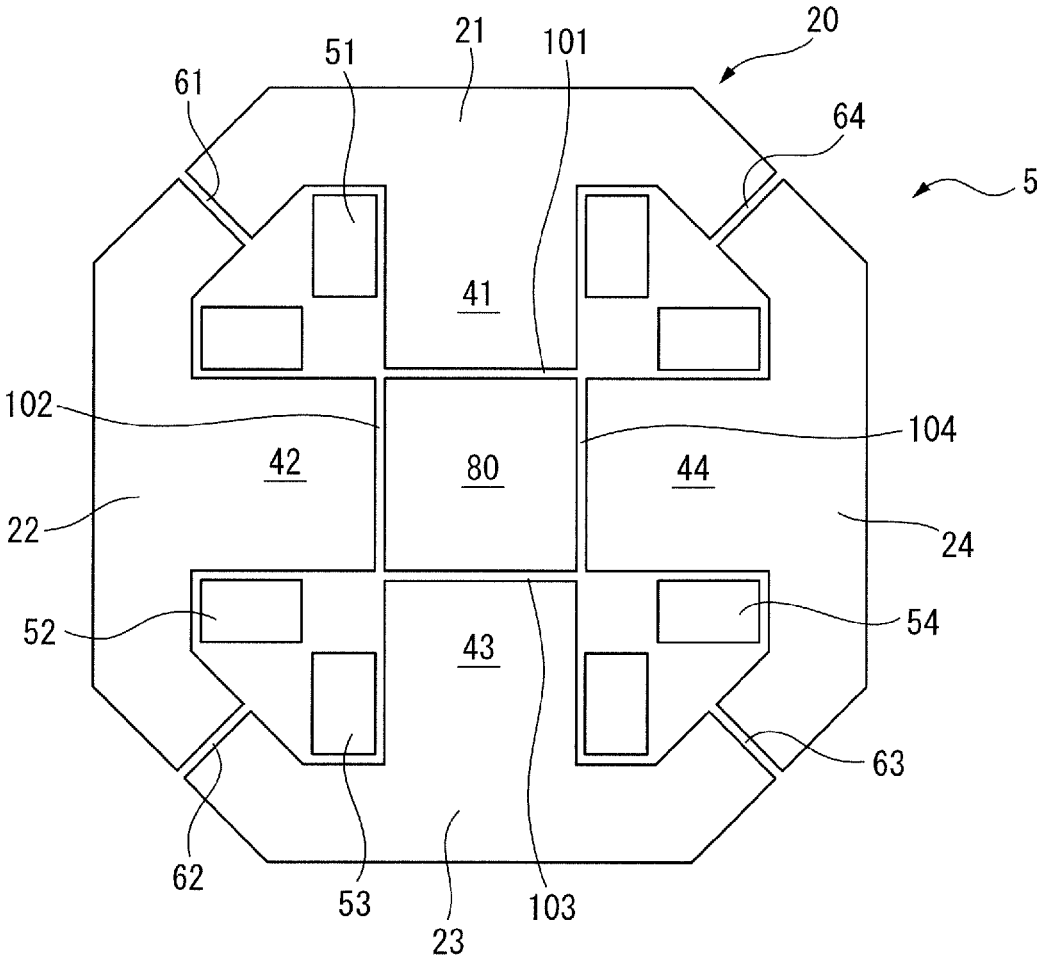
FIG. 26 is a sectional view of still another transformer of the present invention.

FIG. 26 is a sectional view of another transformer of the present invention. In the transformer 5 shown in FIG. 26, outer peripheral iron core portions 21 to 24 are disposed via outer peripheral iron core portion gaps 61 to 64. In such a case, the outer peripheral iron core portion gaps 61 to 64 can be adjusted by adjusting the lengths of the outer peripheral iron core portions 21 to 24. Consequently, it will be understood that the unbalance of the inductance of transformer 5 can be adjusted.

The transformer 5 shown in FIG. 26 differs from the transformer 5 shown in FIG. 25 only in that it has the outer peripheral iron core portion gaps 61 to 64. In the embodiments shown in FIG. 25 and FIG. 26, even if the outer peripheral iron core 20 is large, such an outer peripheral iron core 20 can be easily produced.

Figure 27:
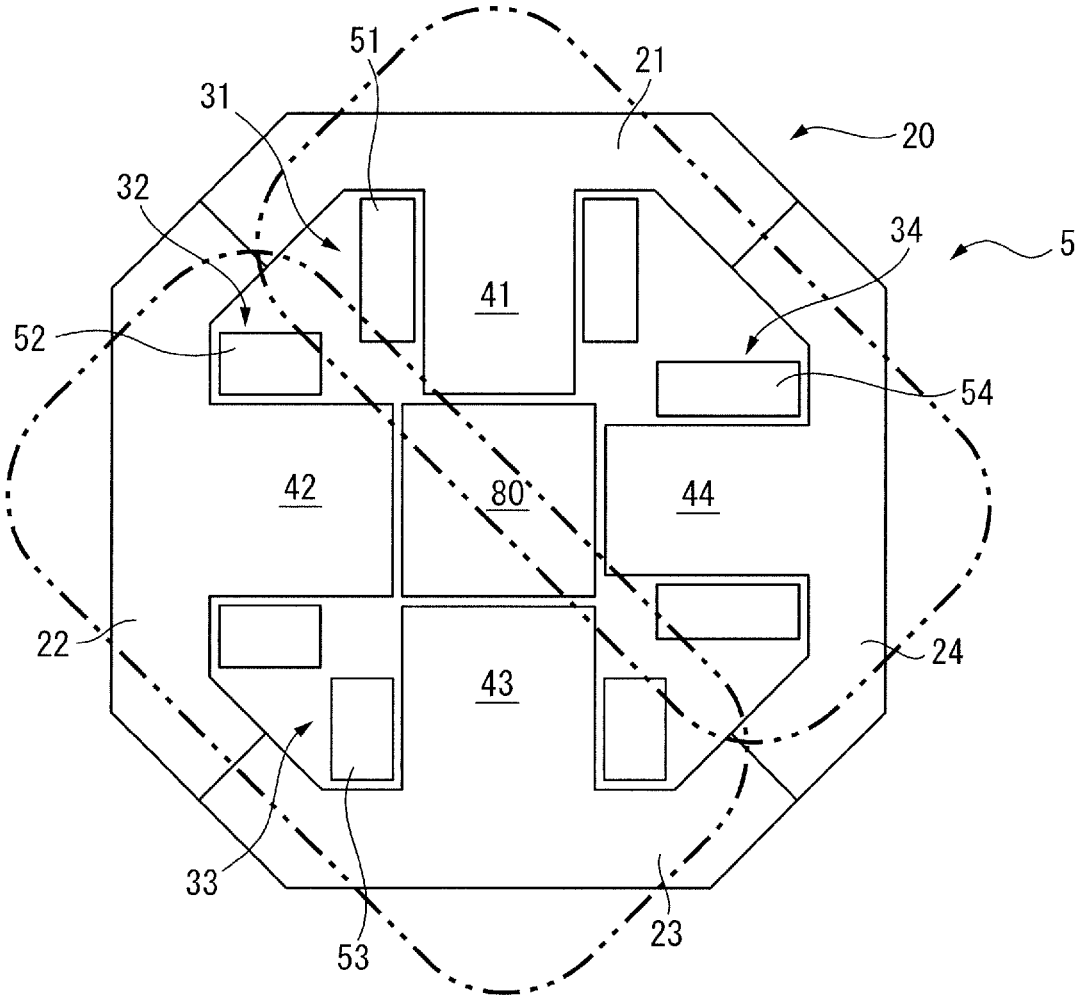
FIG. 27 is a sectional view of still another transformer of the present invention.

FIG. 27 is a sectional view of still another transformer of the present invention. In the transformer 5 shown in FIG. 27, the sectional areas of coils 51 and 54 of iron core coils 31 and 34 are larger than the sectional areas of coils 52 and 53 of iron core coils 32 and 33. Further, iron cores 41 and 44 of the iron core coils 31 and 34 are narrower than iron cores 42 and 43 of the iron core coils 32 and 33. Note that the dimensions of gaps 101 to 104 are equal to one another.

In other words, as designated by two-dot chain lines in FIG. 27, the transformer 5 includes a first set comprised of two iron core coils 31 and 34 and a second set comprised of the other two iron core coils 32 and 33. The first set and the second set each include two adjacent ones of the four iron core coils 31 to 34. In the transformer 5 shown in FIG. 27, the dimensions of the iron cores, the sectional areas of the coils, and the number of turns differ between the first set and the second set. Note that, in the transformer 5, the dimensions of the gaps in the first set may be different from those in the second set.

Thus, two transformers having different properties can substantially be included in one transformer 5. Thus, the installation space for two transformers having different properties can be reduced. Further, it will be understood that connecting two transformers in series or in parallel enables adjustment of the inductance value.

Figure 28:
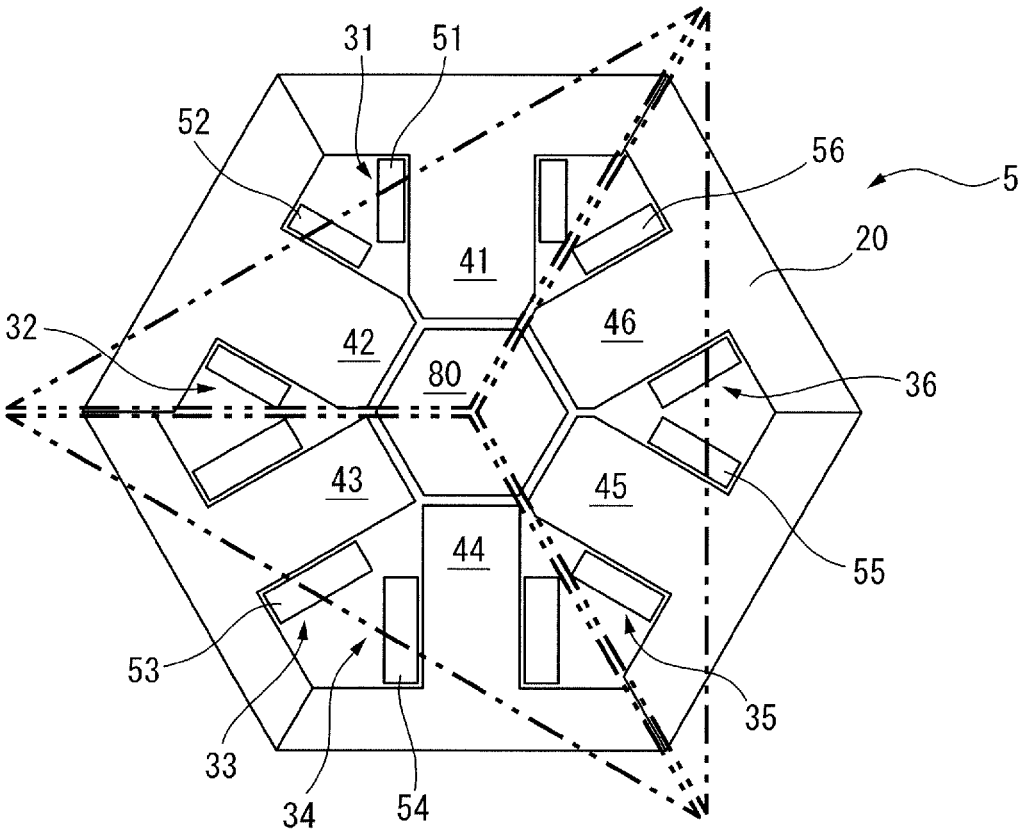
FIG. 28 is a sectional view of still another transformer of the present invention.

FIG. 28 is a sectional view of still another transformer of the present invention. In the transformer 5 shown in FIG. 28, iron cores 41 and 42 are wider than iron cores 45 and 46, and the iron cores 45 and 46 are wider than iron cores 43 and 44. Further, the sectional areas of coils 51 and 52 wound around the iron cores 41 and 42 are smaller than the sectional areas of coils 55 and 56 wound around the iron cores 45 and 46, and the sectional areas of the coils 55 and 56 are smaller than the sectional areas of coils 53 and 54 wound around the iron cores 43 and 44.

Thus, as designated by two-dot chain lines in FIG. 28, the transformer 5 includes a first set comprised of two iron core coils 31 and 32, a second set comprised of another two iron core coils 33 and 34, and a third set comprised of still another two iron core coils 35 and 36. The first to third sets each include two adjacent ones of the six iron core coils 31 to 36.

In the transformer 5 shown in FIG. 28, the dimensions of the iron cores, the sectional areas of the coils, and the number of turns differ among the first to third sets. Note that, in the transformer 5, the dimensions of the gaps in the first set may be different from those in the other sets. It will be understood that such a configuration brings about an effect similar to the effect in the embodiment shown in FIG. 27. Alternatively, four or more transformers having different properties or the same property, i.e., four or more sets described above may be included in one transformer 5. It will be obvious that, even in this case, a similar effect can be obtained.

Disclosure of Aspects

According to a first aspect, there is provided a transformer including an outer peripheral iron core, and at least three iron core coils, which are in contact with or coupled to the inner surface of the outer peripheral iron core. The at least three iron core coils each include an iron core, and at least one of a primary coil and a secondary coil, which are wound around the iron core. Gaps, which can be magnetically coupled, are formed between two adjacent ones of the at least three iron cores, or between the at least three iron cores and a central iron core positioned at the center of the outer peripheral iron core.

According to a second aspect, in the transformer according to the first aspect, the number of the at least three iron core coils is a multiple of 3.

According to a third aspect, in the transformer according to the first aspect, the number of the at least three iron core coils is an even number not less than 4.

According to a fourth aspect, in the transformer according to any of the first to third aspects, the iron core is comprised of a plurality of iron core portions.

According to a fifth aspect, in the transformer according to the fourth aspect, iron core portion gaps, which can be magnetically coupled, are each formed between adjacent ones of the plurality of iron core portions.

According to a sixth aspect, in the transformer according to any of the first to fifth aspects, the outer peripheral iron core is comprised of a plurality of outer peripheral iron core portions.

According to a seventh aspect, in the transformer according to the sixth aspect, outer peripheral iron core portion gaps, which can be magnetically coupled, are each formed between adjacent ones of the plurality of outer peripheral iron core portions.

According to an eighth aspect, in the transformer according to any of the first to seventh aspects, outer peripheral iron core gaps, which can be magnetically coupled, are formed between the iron cores of the at least three iron core coils and the outer peripheral iron core.

According to a ninth aspect, in the transformer according to any of the first to eighth aspects, a gap material or insulating paper, which is a non-magnetic material or resin, is inserted or charged into the gaps, the iron core portion gaps, the outer peripheral iron core portion gaps, or the outer peripheral iron core gaps in the transformer.

According to a tenth aspect, in the transformer according to any of the first to ninth aspects, a gap material or insulating material, which is a non-magnetic material or resin, is charged into the inside of the outer peripheral iron core in the transformer.

According to an eleventh aspect, there is provided a motor driving device including the transformer according to any of the first to tenth aspects.

According to a twelfth aspect, there is provided a machine including the motor driving device according to the eleventh aspect.

According to a thirteenth aspect, there is provided a rectifier device including the transformer according to any of the first to tenth aspects.

According to a fourteenth aspect, there is provided a machine including the rectifier device according to the thirteenth aspect.

Effects of Aspects

In the first aspect, the iron core coils each obtained by winding a winding around an iron core are disposed inside the outer peripheral iron core, and accordingly, the leakage flux from the winding to the circumference can be reduced. Further, providing a shield plate as in a conventional technology is not necessary, and a small transformer can be formed.

Further, in a three-phase transformer, the magnetic path lengths of the three phases are structurally equal, and accordingly, the design and production can be easily performed. Furthermore, the ratio of the primary input voltage to the secondary output voltage is fixed, and accordingly, a control line is not necessary, and the size of the transformer can be further reduced.

In the second aspect, the transformer can be used as a three-phase transformer.

In the third aspect, the transformer can be used as a single-phase transformer.

In the fourth aspect, the coils can be easily attached, and the assembling property of the transformer can be improved.

In the fifth aspect, the gaps between the iron core coils and the iron core portion gaps between the iron core portions are both formed, and accordingly, the dimensions of each gap can be reduced. Thus, the magnetic flux leaking from the gaps can be reduced, and accordingly, the eddy current loss within each coil due to the leaked magnetic flux can be reduced.

In the sixth aspect, the coils can be easily attached, and the assembling property of the transformer can be improved. This is advantageous to making, specifically, a large transformer.

In the seventh aspect, the unbalance of the inductance can be easily adjusted by adjusting the outer peripheral iron core portion gaps.

In the eighth aspect, the outer peripheral iron core gaps are formed between the outer peripheral iron core and the iron core coils, and accordingly, the heat occurring from the iron core coils is difficult to transfer to the outer peripheral iron core.

In the ninth aspect, the oscillation of the iron cores, which are in contact with the gaps, can be reduced, and the noises occurring from the iron cores can be reduced.

In the tenth aspect, the temperature equilibration between the iron core coils and the outer peripheral iron core is promoted, and the noises occurring from the iron core coils or the outer peripheral iron core can be reduced.

In the eleventh to fourteenth aspects, the motor driving device, the machine, and the rectifier device, which include the transformer, can be easily provided.

The present invention has been described above using exemplary embodiments. However, a person skilled in the art would understand that the aforementioned modifications and various other modifications, omissions, and additions can be made without departing from the scope of the present invention. Any appropriate combination of these embodiments is included in the scope of the present invention.

What is claimed is:

1. A transformer comprising:

an outer peripheral iron core; and at least three iron core coils formed separately from and surrounded by the outer peripheral iron core, wherein the at least three iron core coils contact an inner surface of the outer peripheral iron core, wherein the at least three iron core coils each extend only in a radial direction of the outer peripheral iron core; wherein the at least three iron core coils each include an iron core, and a primary coil and a secondary coil, which are wound only around the iron core, each of radially outside ends of the iron core of the at least three iron core coils are in contact with the outer peripheral iron core, and each of radially inside ends of two adjacent ones of the at least three iron cores, around which the primary coil and the secondary coil are only wound, converge on a center of the outer peripheral iron core, are magnetically coupled via a gap including the center of the outer peripheral iron core such that the gap: forms a Y-shape between the adjacent inner ends of the at least three iron cores, occurs between each of the two adjacent ones of the at least three iron cores, and extends radially from the converged center of the outer peripheral iron core to only a space located between the coils of the two adjacent iron cores and the inner surface of the outer peripheral iron core.

2. The transformer according to claim 1, wherein the number of the at least three iron core coils is a multiple of 3.

3. The transformer according to claim 1, wherein the number of the at least three iron core coils is an even number not less than 4.

4. The transformer according to claim 1, wherein a gap material or insulating paper, which is a non-magnetic material or resin, is inserted or charged into the gaps in the transformer.

5. The transformer according to claim 1, wherein a gap material or insulating material, which is a non-magnetic material or resin, is charged into the inside of the outer peripheral iron core in the transformer.

6. The transformer according to claim 1, wherein radially inside ends of the iron cores converge on the center of the outer peripheral iron core.

7. The transformer of claim 1, further comprising a central iron core including the center of the outer peripheral iron core, wherein each of the radially inside ends of the at least three iron cores, which are adjacent with each other and around which at least one of the primary coil and the secondary coil are wound, are magnetically coupled.

8. The transformer according to claim 1, wherein the iron core is comprised of a plurality of iron core portions.

9. The transformer according to claim 8, wherein iron core portion gaps, which can be magnetically coupled, are each formed between adjacent ones of the plurality of iron core portions.

10. The transformer according to claim 9, wherein a gap material or insulating paper, which is a non-magnetic material or resin, is inserted or charged into the iron core portion gaps in the transformer.

11. The transformer according to claim 1, wherein the outer peripheral iron core is comprised of a plurality of outer peripheral iron core portions.

12. The transformer according to claim 11, wherein outer peripheral iron core portion gaps, which can be magnetically coupled, are each formed between adjacent ones of the plurality of outer peripheral iron core portions.

13. The transformer according to claim 12, wherein a gap material or insulating paper, which is a non-magnetic material or resin, is inserted or charged into the outer peripheral iron core portion gaps in the transformer.

14. The transformer according to claim 1, wherein outer peripheral iron core gaps, which can be magnetically coupled, are formed between the iron cores of the at least three iron core coils and the outer peripheral iron core.

15. The transformer according to claim 14, wherein a gap material or insulating paper, which is a non-magnetic material or resin, is inserted or charged into the outer peripheral iron core gaps in the transformer.

16. A motor driving device comprising the transformer according to claim 1.

17. A machine comprising the motor driving device according to claim 16.

18. A rectifier device comprising the transformer according to claim 1.

19. A machine comprising the rectifier device according to claim 18.

* * * * *